US009606469B2

(12) United States Patent
Izumi et al.

(10) Patent No.: US 9,606,469 B2
(45) Date of Patent: Mar. 28, 2017

(54) IMAGE FORMING APPARATUS AND CHARGING BIAS ADJUSTING METHOD THEREFOR

(71) Applicants: Saki Izumi, Kanagawa (JP); Hiroyuki Sugiyama, Kanagawa (JP); Shunichi Hashimoto, Kanagawa (JP); Naoyuki Ozaki, Kanagawa (JP); Mikio Ishibashi, Kanagawa (JP); Kayoko Tanaka, Tokyo (JP); Kohta Fujimori, Kanagawa (JP)

(72) Inventors: Saki Izumi, Kanagawa (JP); Hiroyuki Sugiyama, Kanagawa (JP); Shunichi Hashimoto, Kanagawa (JP); Naoyuki Ozaki, Kanagawa (JP); Mikio Ishibashi, Kanagawa (JP); Kayoko Tanaka, Tokyo (JP); Kohta Fujimori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/155,317

(22) Filed: May 16, 2016

(65) Prior Publication Data

US 2016/0349658 A1 Dec. 1, 2016

(30) Foreign Application Priority Data

May 26, 2015 (JP) ..... 2015-106642

(51) Int. Cl.
*G03G 15/02* (2006.01)

(52) U.S. Cl.
CPC ..... *G03G 15/0266* (2013.01)

(58) Field of Classification Search
USPC ..... 399/38, 42, 44, 46, 49, 50, 72
See application file for complete search history.

(56) References Cited

U.S. PATENT DOCUMENTS 9,042,757 B2 * 5/2015 Hirobe ..... G03G 15/0824 399/59
2009/0324267 A1 12/2009 Yoshida et al.
(Continued)

FOREIGN PATENT DOCUMENTS

| | | |
|---|---|---|
| JP | 2006-078889 | 3/2006 |
| JP | 2008-083461 | 4/2008 |
| JP | 2015-087563 | 5/2015 |

*Primary Examiner* — Hoan Tran
(74) *Attorney, Agent, or Firm* — Oblon, McClelland, Maier & Neustadt, L.L.P.

(57) ABSTRACT

An image forming apparatus includes a latent image bearer to rotate, an image forming unit including a charger and a developing device, a charge power supply to output a charging bias applied to a charger, a transfer device, a toner adhesion amount, and a controller. The controller causes the image forming unit to form a background fog pattern in a background area of the latent image bearer while changing a background potential, acquires toner adhesion amount values detected at different positions of the background fog pattern, having different potentials, sorts the toner adhesion amount values in an order of the background potential, determines a relation between the background potential and background fog amount based the toner adhesion amount values except any toner adhesion amount value out of monotonicity, and adjust the charging bias to an optimum value computed based on the determined relation.

11 Claims, 14 Drawing Sheets

(56) References Cited

U.S. PATENT DOCUMENTS

| | | | |
|---|---|---|---|
| 2010/0226664 | A1 | 9/2010 | Yoshida et al. |
| 2011/0058832 | A1 | 3/2011 | Suzuki et al. |
| 2012/0294637 | A1 | 11/2012 | Tanaka et al. |
| 2013/0156449 | A1 | 6/2013 | Fujimori et al. |
| 2013/0236200 | A1 | 9/2013 | Tanaka et al. |
| 2014/0294412 | A1 | 10/2014 | Tanaka et al. |
| 2014/0348521 | A1 | 11/2014 | Mase et al. |
| 2015/0117884 | A1 | 4/2015 | Sugiyama et al. |
| 2015/0139668 | A1 | 5/2015 | Sugiyama et al. |
| 2015/0139674 | A1 | 5/2015 | Sugiyama et al. |
| 2015/0234316 | A1 | 8/2015 | Kanaya et al. |
| 2015/0370196 | A1 | 12/2015 | Ozaki et al. |

* cited by examiner

IMAGE FORMING APPARATUS AND CHARGING BIAS ADJUSTING METHOD THEREFOR

CROSS-REFERENCE TO RELATED APPLICATIONS

This patent application is based on and claims priority pursuant to 35 U.S.C. §119(a) to Japanese Patent Application No. 2015-106642, filed on May 26, 2015, in the Japan Patent Office, the entire disclosure of which is hereby incorporated by reference herein.

BACKGROUND

Technical Field

Embodiments of the present invention generally relate to an image forming apparatus, such as a copier, a printer, a facsimile machine, or a multifunction peripheral (MFP) having at least two of copying, printing, facsimile transmission, plotting, and scanning capabilities, and a charging bias adjusting method therefor.

Description of the Related Art

There are image forming apparatuses that form a pattern on a background area of a latent image bearer for detecting the amount of background fog (toner stain on the background area), determine the relation between a background potential and the amount of toner adhering to the background, and determine a charging bias for charging the latent image bearer based on the determined relation. Then, the charging bias in subsequent print jobs is adjusted.

SUMMARY

An embodiment of the present invention provides an image forming apparatus that includes a latent image bearer to rotate, an image forming unit to form a toner image, a charge power supply to output a charging bias applied to the charger, a transfer device to transfer the toner image from the latent image bearer onto a transfer medium, a toner adhesion amount detector to detect an amount of toner adhering to one of the latent image bearer and the transfer medium, and a controller configured to execute processing described below. The image forming unit includes a charger to charge a surface of the latent image bearer, and a developing device including a developer bearer disposed facing the latent image bearer, the developing device to develop the latent image into a toner image.

The controller is configured to cause the image forming unit to form a background fog pattern in a background area of the latent image bearer while changing a background potential, which is a potential difference between the background area of the latent image bearer and the developer bearer; acquire a plurality of toner adhesion amount values respectively detected at different positions (having different potentials) in the background fog pattern by the toner adhesion amount detector; sort the plurality of toner adhesion amount values in a magnitude order of the background potential; exclude any toner adhesion amount value out of monotonicity from the plurality of toner adhesion amount values; determine a relation between the background potential and a background fog amount based on a rest of the plurality of toner adhesion amount values; and adjust the charging bias output from the charge power supply to an optimum value computed based on the determined relation between the background potential and the background fog amount.

Another embodiment provides a charging bias adjusting method that includes forming a background fog pattern in a background area of a latent image bearer while changing a background potential, which is a potential difference between the background area of the latent image bearer and a developer bearer; acquiring a plurality of toner adhesion amount values respectively detected at different positions (having different potential) in the background fogs; sorting the plurality of toner adhesion amount values in a magnitude order of the background potential; excluding any toner adhesion amount value out of monotonicity from the plurality of toner adhesion amount values; determining a relation between the background potential and a background fog amount based on a rest of the plurality of toner adhesion amount values; and adjusting the charging bias to an optimum value computed based on the determined relation between the background potential and the background fog amount.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
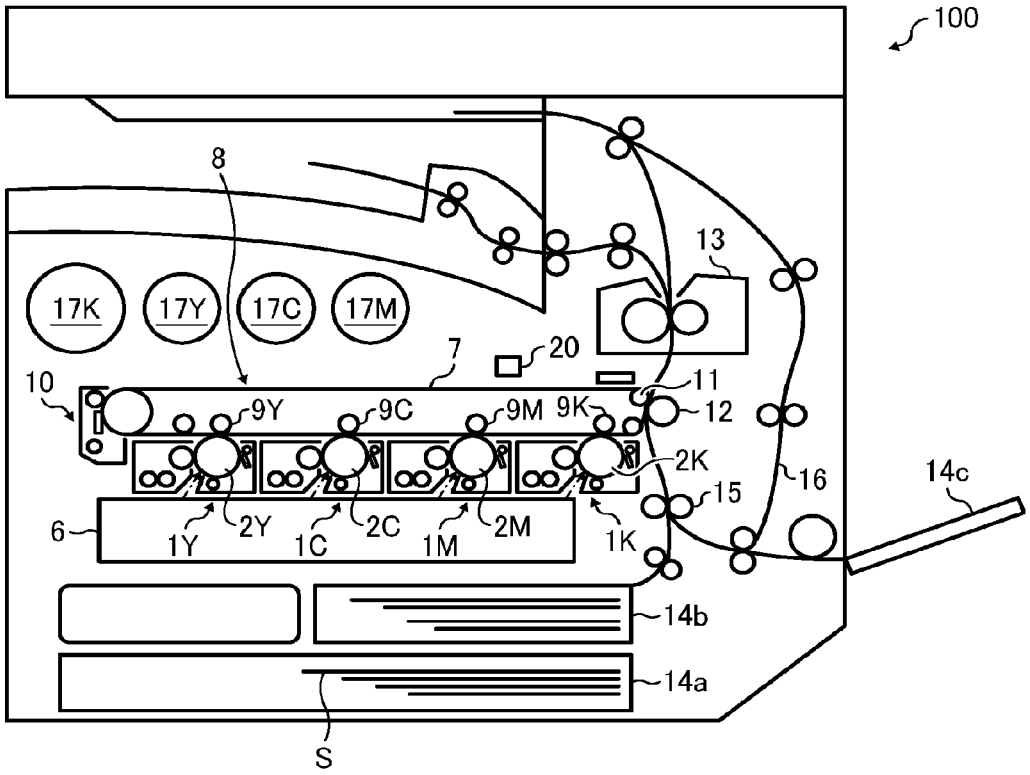
FIG. 1 is a schematic diagram of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a basic configuration of an image forming apparatus 100 according to the present embodiment is described below.

FIG. 1 is a schematic diagram illustrating the image forming apparatus 100.

The image forming apparatus 100 includes four image forming units 1Y, 1C, 1M, and 1K (also collectively "image forming units 1") for forming yellow (Y), cyan (C), magenta (M), and black (K) images, respectively. It is to be noted that reference characters Y, C, M, and K represent yellow, cyan, magenta, and black, respectively, and may be omitted in the description below when color discrimination is not necessary. The arrangement order of Y, C, M, and K is not limited to the order illustrated in FIG. 1.

Figure 2:
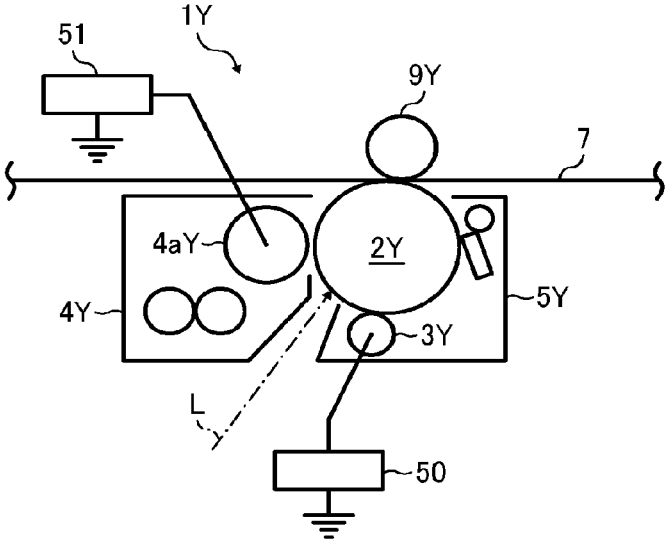
FIG. 2 is an end-on axial view illustrating a main part of an image forming unit included in the image forming apparatus illustrated in FIG. 1.

FIG. 2 illustrates a configuration of the image forming unit 1Y of the image forming apparatus 100. As illustrated in FIG. 2, the image forming unit 1Y includes a drum-shaped photoconductor 2Y serving as a latent image bearer, and a charging roller 3Y serving as a charger, a developing device 4Y, and a cleaning device 5Y are disposed around the photoconductor 2Y. The charging roller 3Y is, for example, a rubber roller and configured to rotate while contacting the surface of the photoconductor 2Y. The image forming apparatus 100 according to the present embodiment employs contact-type DC (direct current) charging, and a charging bias Vc applied to the charging roller 3Y is a DC bias without an AC (alternating current) component. Alternatively, a contact-type charging roller or a contactless charging roller can be adopted as the charging roller 3Y.

The developing device 4Y contains two-component developer including magnetic carrier (magnetic carrier particles) and toner (toner particles). The two-component developer used in the present embodiment includes toner having an average particle diameter ranging from 4.9 μm to 5.5 μm and carrier having a small diameter and a low resistivity. The carrier has a bridge resistivity of 12.1 Log Ω·cm or lower. The developing device 4Y includes a developing roller 4*a*Y disposed facing the photoconductor 2Y, a screw to transport and stir the developer, and a toner concentration sensor. The developing roller 4*a*Y includes a rotatable, hollow developing sleeve and a magnetic roller disposed inside the developing sleeve. The magnetic roller is configured not to rotate together with the developing sleeve.

The image forming unit 1Y is configured as a process cartridge, and the photoconductor 2Y and the components disposed therearound, namely, the charging roller 3Y, the developing device 4Y, and the cleaning device 5Y are supported by a common frame (a supporter). The image forming unit 1Y is removably installable in an apparatus body of the image forming apparatus 100. Thus, multiple consumables are replaced at a time when the operational lives thereof expire. The other image forming units 1C, 1M, and 1K are similar in configuration to the image forming unit 1Y, differing only in the color of toner employed. Below the image forming units 1Y, 1C, 1M, and 1K, an optical writing unit 6 serving as a latent-image writing device to write a latent image writing device on the photoconductors 2Y, 2C, 2M, and 2K (collectively "photoconductors 2") is disposed. The optical writing unit 6 includes a light source, a polygon mirror, an f-O lens, and reflection mirrors and is configured to direct laser beams L onto the surfaces of the photoconductors 2Y, 2C, 2M, and 2K according to image data. Accordingly, the electrostatic latent images of yellow, cyan, magenta, and black are formed on the photoconductors 2Y, 2M, 2C, and 2K, respectively.

An intermediate transfer unit 8 disposed above the image forming units 1Y, 1C, 1M, and 1K transfers toner images of respective colors from the photoconductors 2Y, 2C, 2M, and 2K via an intermediate transfer belt 7 onto a recording sheet S (i.e., a recording medium). The intermediate transfer belt 7 is entrained around a plurality of rollers and rotated counterclockwise in FIG. 1 as at least one of the plurality of rollers rotates. The intermediate transfer belt 7 serves as a transfer medium or an intermediate transfer member. The intermediate transfer member includes an intermediate transfer drum. Alternatively, the recording sheet S may serve as a transfer medium.

The intermediate transfer unit 8 includes the intermediate transfer belt 7, primary transfer rollers 9Y, 9C, 9M, and 9K, a belt cleaning device 10, a secondary-transfer backup roller 11, and an optical sensor unit 20. The belt cleaning device 10 includes a brush roller or a cleaning blade.

The intermediate transfer belt 7 is nipped between the photoconductors 2 and the primary transfer rollers 9Y, 9C, 9M, and 9K. The portions where the photoconductors 2Y, 2M, 2C, and 2K are in contact with the outer surface of the intermediate transfer belt 7 are called primary transfer nips. The intermediate transfer unit 8 further includes a secondary transfer roller 12 disposed downstream from the image forming unit 1K in the direction of rotation of the intermediate transfer belt 7 (hereinafter "belt travel direction") and adjacent to the secondary-transfer backup roller 11. The secondary transfer roller 12 is disposed outside the loop of the intermediate transfer belt 7. The secondary transfer roller 12 and the secondary-transfer backup roller 11 press against each other via the intermediate transfer belt 7, and the contact portion therebetween is hereinafter referred to as a secondary transfer nip.

A fixing device 13 is disposed above the secondary transfer roller 12. The fixing device 13 includes a fixing roller and a pressing roller that press against each other while rotating. The contact portion therebetween is called a fixing nip. The fixing roller contains a heat source such as a halogen heater. A power source supplies power to the heater to heat the surface of the fixing roller to a predetermined temperature.

In a lower section of the apparatus body, sheet trays 14*a* and 14*b* for containing recording sheets S, sheet feeding rollers, and a registration roller pair 15 are disposed. Additionally, a side tray 14*c* is disposed on a side of the apparatus body for sheet feeding from the side. On the right of the intermediate transfer unit 8 and the fixing device 13 in FIG. 1, a sheet reversing path 16 is disposed to again transport the recording sheet S to the secondary transfer nip in duplex printing.

In an upper section of the apparatus, toner containers 17Y, 17C, 17M, and 17K are disposed to supply toner to the respective developing devices 4 of the image forming units 1Y, 1C, 1M, and 1K. The image forming apparatus 100 further includes a waste-toner bottle, a power supply unit, and the like.

Next, operation of the image forming apparatus 100 is described below.

Initially, a charge power unit 50 (illustrated in FIGS. 2 and 3) applies a predetermined or desirable voltage (the charging bias Vc) to the charging roller 3Y. Then, the charging roller 3Y charges the surface of the photoconductor 2Y facing the charging roller 3Y. The optical writing unit 6 directs the laser beam L according to the image data onto the surface of the photoconductor 2Y that is charged to a predetermined or desirable potential, thus forming an electrostatic latent image thereon. When the electrostatic latent image on the surface of the photoconductor 2Y reaches a position facing the developing roller 4*a*Y, the developing roller 4*a*Y supplies toner thereto, thereby forming a yellow toner image on the photoconductor 2Y. The developing device 4Y is supplied with toner from the toner containers 17Y in accordance with output from the toner concentration sensor.

Similar operation is performed in the image forming units 1C, 1M, and 1K at predetermined timings. Thus, yellow, cyan, magenta, and black toner images are formed on the photoconductors 2Y, 2C, 2M, and 2K, respectively. The yellow, cyan, magenta, and black toner images are transferred from the photoconductors 2Y, 2C, 2M, and 2K in the respective primary transfer nips and sequentially superimposed one on another on the intermediate transfer belt 7. Each of the primary transfer rollers 9Y, 9C, 9M, and 9K receives a primary transfer bias that is opposite in polarity to the toner from a transfer power supply.

The recording sheet S is fed from one of the sheet trays 14*a* and 14*b* and the side tray 14*c*, and the registration roller pair 15 stops the recording sheet S. The registration roller pair 15 rotates at a predetermined timing to forward the recording sheet S to the secondary transfer nip.

The toner images superimposed on the intermediate transfer belt 7 are transferred onto the recording sheet S in the secondary transfer nip, where the secondary transfer roller 12 is in contact with the intermediate transfer belt 7. A secondary transfer bias opposite in polarity to the toner is applied to the secondary transfer roller 12 from a secondary-transfer power supply. After exiting the secondary transfer nip, the sheet S is transported to the fixing device 13 and nipped between the fixing roller and the pressing roller (i.e., the fixing nip). The toner image is fixed on the recording sheet S in the fixing nip with heat from the fixing roller. In single-side printing, after the toner image is fixed thereon, the recording sheet S is transported by conveyance rollers and ejected from the apparatus. In duplex printing, the conveyance rollers transport the recording sheet S to the sheet reversing path 16, where the recording sheet S is turned upside down. Then, an image is formed on the opposite side of the recording sheet S, and the recording sheet S is ejected.

The image forming apparatus 100 according to the present embodiment executes a control operation called "process control" at predetermined timings to stabilize image quality in accordance with environmental changes and with the elapse of time. In the process control, a yellow toner patch pattern (a toner image) including multiple toner patches is formed on the photoconductor 2Y and transferred onto the intermediate transfer belt 7. Similarly, cyan, magenta, and black toner patch patterns are formed on the photoconductors 2C, 2M, and 2K. Subsequently, the optical sensor unit 20 detects the amount of toner adhering to each toner patch in the toner patch pattern. According to the detection results generated by the optical sensor unit 20, a controller 30 (illustrated in FIG. 3) adjusts image forming conditions such a developing bias Vb.

Figure 3:
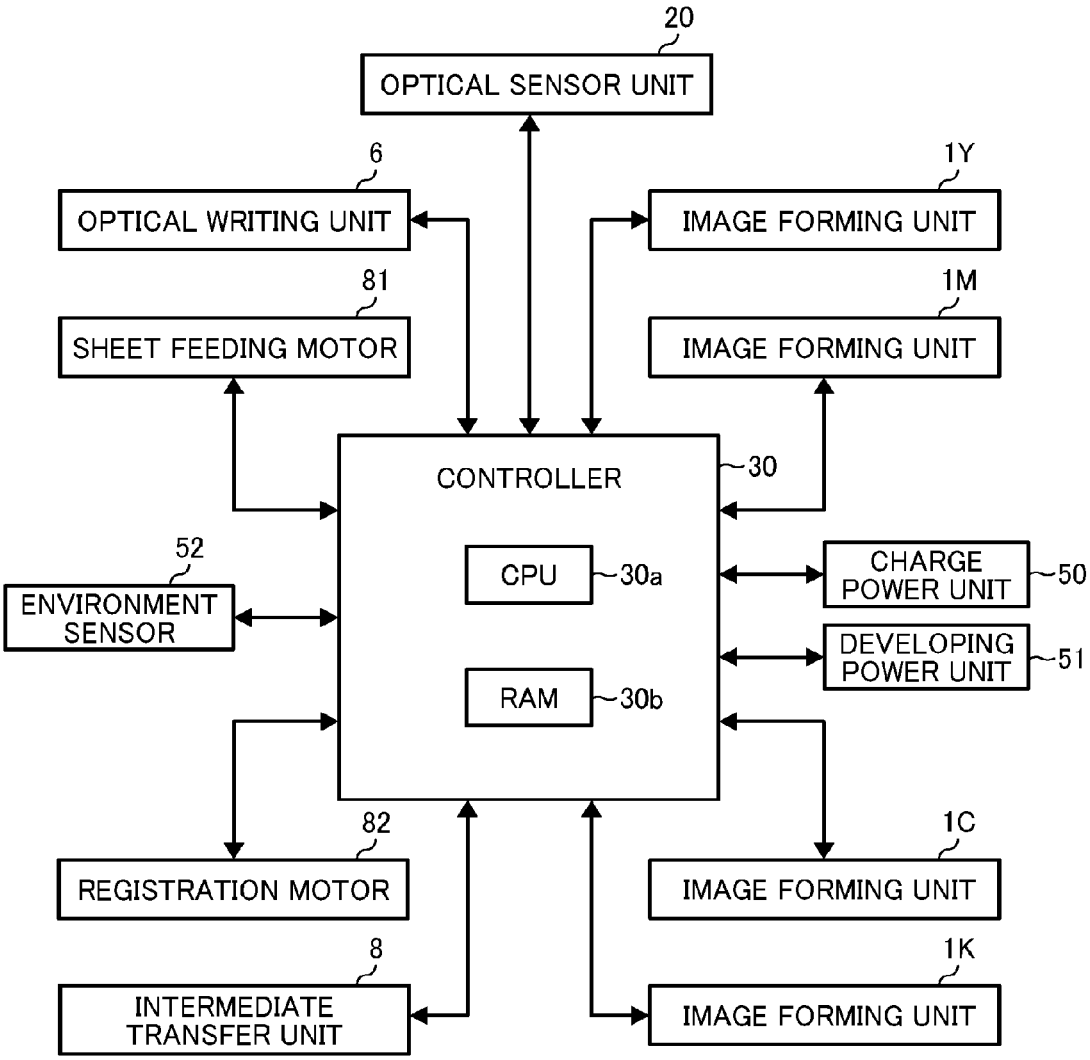
FIG. 3 is a block diagram illustrating electrical circuitry of the image forming apparatus illustrated in FIG. 1.
Figure 4:
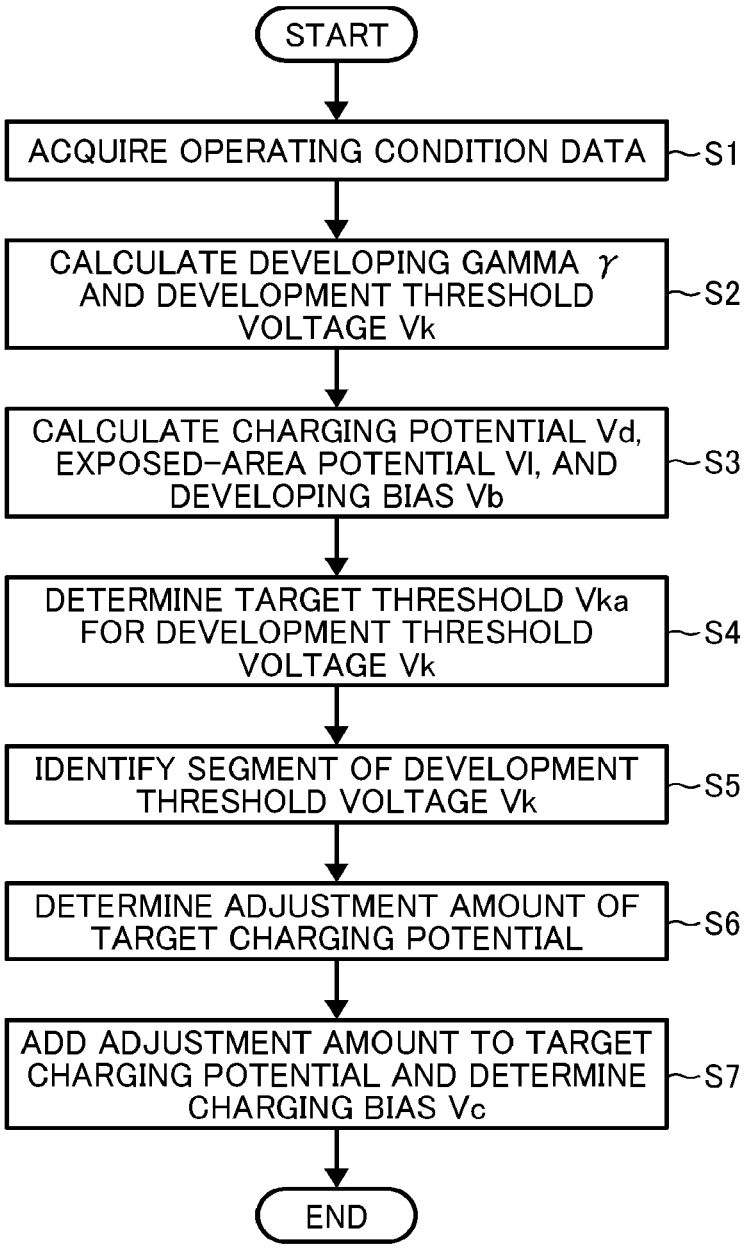
FIG. 4 is a flowchart of computation in process control according to an embodiment.

FIG. 3 is a block diagram illustrating electrical circuitry of the image forming apparatus 100. FIG. 4 is a flowchart of computation in the process control.

As illustrated in FIG. 3, to the controller 30, the image forming units 1Y, 1C, 1M, and 1K, the optical writing unit 6, a sheet feeding motor 81, a registration motor 82, the intermediate transfer unit 8, and the optical sensor unit 20 are connected electrically. Further, the charge power unit 50, a developing power unit 51, and an environment detector 52 are connected to the controller 30. The controller 30 includes a central processing unit (CPU) 30*a* to execute computation and various types of programs and a random access memory (RAM) 30*b* to store data. It is to be noted that the sheet feeding motor 81 serves as a driver to drive the sheet feeding rollers to feed sheets from the sheet trays 14*a* and 14*b* and the side tray 14*c*. The registration motor 82 serves as a driver of the registration roller pair 15.

The optical sensor unit 20 includes multiple reflective photosensors arranged at regular intervals in a width direction of the intermediate transfer belt 7. Each of the reflective photosensors is configured to output a signal corresponding to the reflectance of light of the toner patches on the intermediate transfer belt 7. In the present embodiment, there are four reflective photosensors (first, second, third, and fourth reflective photosensors 20*a*, 20*b*, 20*c*, and 20*d* illustrated in FIG. 5). Three of the four reflective photosensors capture both of specular reflection and diffuse reflection of light on the surface of the belt and output signals according to the amount of specular reflection of light and diffuse reflection light so that the output correspond to yellow, magenta, and cyan toner. The remaining one captures only the specular reflection on the surface of the belt and outputs the signal according to the amount of specular reflection light so that the output corresponds to black toner.

The controller 30 executes the process control at a predetermined timing, such as, turning on of a main power, standby time after elapse of a predetermined period, and standby time after printing on a predetermined number of sheets or greater. The steps in the process control are described with reference to FIG. 4. At S1, when the predetermined timing arrives, the controller 30 acquires operating condition data such as the number of sheets printed, the printing ratio, ambient temperature, and ambient humidity. Subsequently, the controller 30 determines developing characteristics in each of the image forming units 1Y, 1C, 1M, and 1K. Specifically, at S2, the controller 30 calculates a developing gamma γ and a development threshold voltage Vk for each color. More specifically, while the photoconductors 2Y, 2C, 2M, and 2K rotate, the charging rollers 3 charge uniformly the surfaces of the photoconductors 2Y, 2C, 2M, and 2K, respectively. In the charging, differently from standard printing, the charging bias Vc is not constant (e.g., −700 V) but is gradually increased in absolute value. With the scanning with the laser beams L, the optical writing unit 6 forms electrostatic latent images for the yellow, cyan, magenta, and black toner patch patterns on the photoconductors 2Y, 2C, 2M, and 2K. The developing devices 4Y, 4C, 4M, and 4K develop the latent images into the yellow, cyan, magenta, and black toner patch patterns on the photoconductors 2Y, 2C, 2M, and 2K. It is to be noted that, in the developing process, the controller 30 progressively increases the developing bias Vb applied to the developing rollers 4*a* for the respective colors. In the present embodiment, the developing bias Vb and the charging bias Vc are DC biases in negative polarity.

Figure 5:
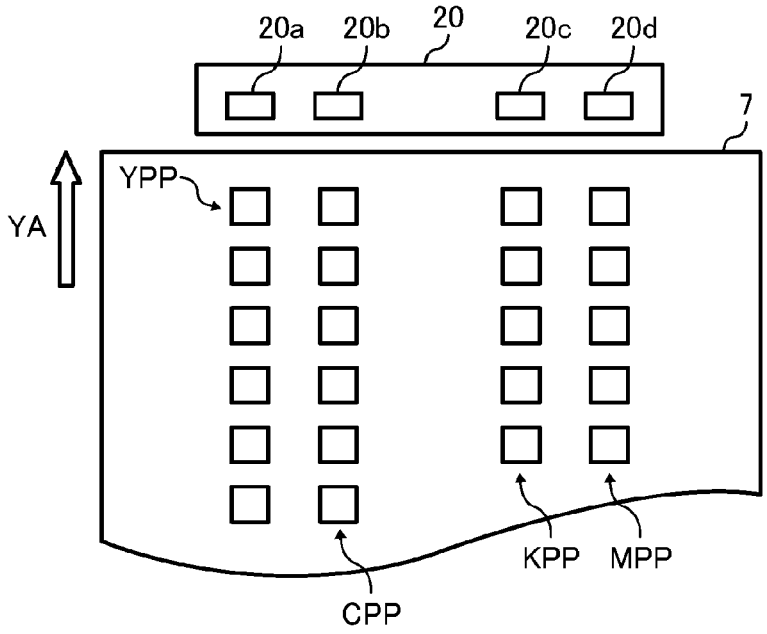
FIG. 5 is a schematic diagram illustrating toner patch patterns on an intermediate transfer belt of in the image forming apparatus illustrated in FIG. 1.

FIG. 5 illustrates the toner patch patterns on the intermediate transfer belt 7. In FIG. 5, reference characters YA represents the belt travel direction; and YPP, CPP, KPP, and MPP represent the yellow, cyan, magenta, and black toner patch patterns, respectively (collectively "toner patch patterns PP"). As illustrated in FIG. 5, the yellow, cyan, magenta, and black toner patch patterns YPP, CPP, MPP, and KPP does not overlap with each other on the intermediate transfer belt 7 but are lined in the width direction of the intermediate transfer belt 7 (hereinafter "belt width direction"). Specifically, the toner patch pattern YPP is disposed on a first end side (on the left in FIG. 5) of the intermediate transfer belt 7 in the belt width direction. The toner patch pattern CPP is disposed at a position shifted to a center from the toner patch pattern YPP on the intermediate transfer belt 7 in the belt width direction. The toner patch pattern MPP is disposed on a second end side (on the right in FIG. 5) of the intermediate transfer belt 7 in the belt width direction. The toner patch pattern KPP is disposed at a position shifted to the center from the toner patch pattern MPP on the intermediate transfer belt 7 in the belt width direction.

The optical sensor unit 20 includes the first reflective photosensor 20*a*, the second reflective photosensor 20*b*, the third reflective photosensor 20*c*, and the fourth reflective photosensor 20*d* to detect the light reflection characteristics of the intermediate transfer belt 7 at positions different in the belt width direction. Of the four reflective photosensors, the third reflective photosensor 20*c* detects only the specular reflection of light on the surface of the intermediate transfer belt 7 to detect changes in the light reflection characteristics derived from the amount of black toner adhering to the intermediate transfer belt 7. By contrast, the first, second, and fourth reflective photosensors 20*a*, 20*b*, and 20*d* detect both of the specular reflection and the diffuse reflection of light to detect changes in the light reflection characteristics derived from the amount of yellow, cyan, or magenta toner adhering to the intermediate transfer belt 7.

The first reflective photosensor 20*a* is disposed to face the first end side of the intermediate transfer belt 7 in the belt width direction to detect the amount of toner adhering to the yellow toner patches in the toner patch pattern YPP. The second reflective photosensor 20*b* is disposed to face the position shifted from the first end side to the center in the belt width direction of the intermediate transfer belt 7 to detect the amount of toner adhering to the cyan toner patches in the toner patch pattern CPP. The fourth reflective photosensor 20*d* is disposed to face the second end side of the intermediate transfer belt 7 in the belt width direction to detect the amount of toner adhering to the magenta toner patches in the toner patch pattern MPP. The third reflective photosensor 20*c* is disposed to face the position shifted from the second end side to the center in the belt width direction of the intermediate transfer belt 7 to detect the amount of toner adhering to the black toner patches in the toner patch pattern KPP. It is to be noted that each of the first reflective photosensor 20*a*, the second reflective photosensor 20*b*, and the fourth reflective photosensor 20*d* can detect the amount of any of yellow, cyan, and magenta toner other than black toner.

Figure 6:
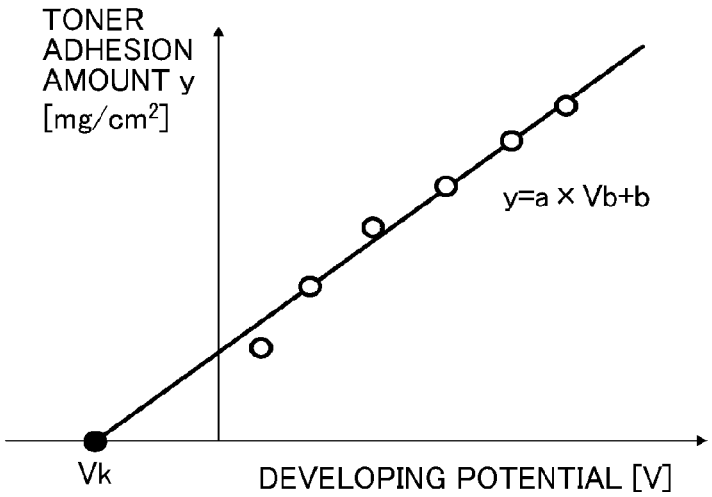
FIG. 6 is a graph illustrating a relation between developing potential and toner adhesion amount.

The controller 30 calculates the reflectance of light of the toner patches of the four colors based on the signals sequentially output from the four photosensors (20*a*, 20*b*, 20*c*, and 20*d*) of the optical sensor unit 20. The controller 30 obtains the amount of toner adhering (also "toner adhesion amount)" to each toner patch based on the computation result and stores the calculated toner adhesion amount in the RAM 30*b*. After passing by the position facing the optical sensor unit 20 as the intermediate transfer belt 7 rotates, the toner patch patterns PP are removed from the intermediate transfer belt 7 by the belt cleaning device 10. Subsequently, based on the toner adhesion amounts (i.e., image density data) thus stored in the RAM 30*b* and exposed-area potentials (i.e., latent image potentials), which are stored in the RAM 30*b* as well, the controller 30 obtains an approximate straight line ($y=a\times Vb+b$) illustrated in FIG. 6. In the two-dimensional coordinate illustrated in FIG. 6, the x-axis represents the developing potential (Vl−Vb), which is obtained by deducting, from the exposed-area potential Vl, the developing bias Vb applied to the developing roller 4*a* at that time. The y-axis in FIG. 6 represents the toner adhesion amount (y) per unit area. The number of data values plotted on X-Y plane in FIG. 6 matches the number of the toner patches. Based on the multiple data values plotted, a section of the X-Y plane in which linear approximation is executed is determined. The controller 30 obtains the approximate straight line ($y=a\times Vb+b$) through a least squares method. Then, based on the approximate straight line, the controller 30 calculates the developing gamma γ and the development threshold voltage Vk. The developing gamma γ is calculated as the inclination of the approximate straight line ($\gamma=a$). The development threshold voltage Vk is calculated as the intersection of the approximate straight line with the x-axis ($Vk=-b/a$). Thus, the developing characteristics of the image forming units 1Y, 1C, 1M, and 1K are calculated at S2.

At S3, based on the calculated developing characteristics, the controller 30 calculates a target for the charging potential Vd (i.e., potential in background areas), a target exposed-area potential (hereinafter "target exposed-area potential"), and the developing bias Vb. Specifically, the target for the charging potential Vd (hereinafter "target charging potential") and the target exposed-area potential are obtained based on a table in which the relation between the developing gamma γ, the charging potential Vd, and the exposed-area potential Vl are predetermined. With this configuration, the controller 30 selects the target charging potential and the target exposed-area potential suitable for the developing gamma γ. Additionally, to obtain the developing bias Vb, the controller 30 obtains a developing potential to attain a largest toner adhesion amount based on the combination of the developing gamma γ and the development threshold voltage Vk and then obtains the developing bias Vb to attain the developing potential. Based on the developing bias Vb and the background potential, the controller 30 calculates the target charging potential. Since the surface of the developing sleeve of the developing roller 4*a* has a potential similar to the developing bias Vb, the target developing potential and the target background potential are obtained when the surface of the photoconductor 2 is charged to the target charging potential and exposed properly.

Subsequently, the controller 30 determines the charging bias Vc. Specifically, the charging bias Vc to attain the target charging potential varies depending on the amount of abrasion of the surface layer of the photoconductor 2, the electrical resistance of the charging roller 3 susceptible to environmental changes, and the like. Accordingly, the controller 30 stores an algorithm based on the combination of environmental conditions (temperature and humidity) and the running distance of the photoconductor 2 to calculate the charging bias Vc to attain the target charging potential. The algorithm is preliminarily established experimentally. Using the algorithm, the controller 30 calculates the charging bias Vc to attain the target charging potential based on the combination of the detection result generated by the environment detector 52 and the photoconductor running distance stored in the RAM 30*b*.

Due to the characteristics of developer, the background fog (background stain) is aggravated with elapse of time. By contrast, adhesion of carrier to image edges on the photoconductor 2 is worse at an initial stage and alleviated with elapse of time. Accordingly, the optimum background potential shifts to a greater value as the developer is used. Further, typically, in a hot and humid environment, the background fog is aggravated because the amount of charge of toner is smaller. By contrast, in a cool and dry environment, the adhesion of carrier is aggravated. Therefore, in image density adjustment according to the present embodiment, the background potential is adjusted to an optimum value depending on the stage of use and environment.

The background potentials suitable to suppress the background fog and the adhesion of carrier under various conditions are experimentally obtained in experiments. Accordingly, the background potential can be adjusted to a certain degree based on data on degradation of the charging roller 3 and the carrier and operating condition data such as changes in temperature and humidity. However, it is possible that the optimum background potential fluctuates due to tolerances or errors in the experiment or an unexpected factor. Meanwhile, since the development threshold voltage Vk is equivalent to the voltage at which developing starts on the photoconductor 2, it is conceivable that background fog worsens unless the background potential is equal to or greater in absolute value than the development threshold voltage Vk.

In view of the foregoing, after calculating the charging potential Vd, the exposed-area potential Vl, and developing bias Vb at S3 in FIG. 4, at S4 the controller 30 determines a target for the development threshold voltage Vk (hereinafter "target threshold Vka"). The target threshold Vka is preliminarily and experimentally correlated with the operating condition data in a table stored in the RAM 30*b*. The controller 30 determines the target threshold Vka from the operating condition data initially obtained, with reference to the table. At S5, the controller 30 determines a segment based on the difference between the development threshold voltage Vk and the target threshold Vka. The difference from the target threshold Vka is segmented as follows. For example, in a case where the difference of the development threshold voltage Vk from the target threshold Vka is +40 V or greater, the development threshold voltage Vk is in Segment 1. Segment 2 is for the difference ranging from +20 V to +40 V, and Segment 3 is for the difference ranging from 0 V to +20 V. The controller 30 identifies the segment in which the development threshold voltage Vk falls. At S6, the controller 30 determines the adjustment amount of the target charging potential (the target for the background potential) for each segment. Subsequently, the controller 30 adds the adjustment amount determined at S6 to the target charging potential calculated from the charging potential Vd and the developing bias Vb obtained at S3. At S7, the controller 30 calculates the charging bias Vc to obtain the target charging potential.

Figure 7:
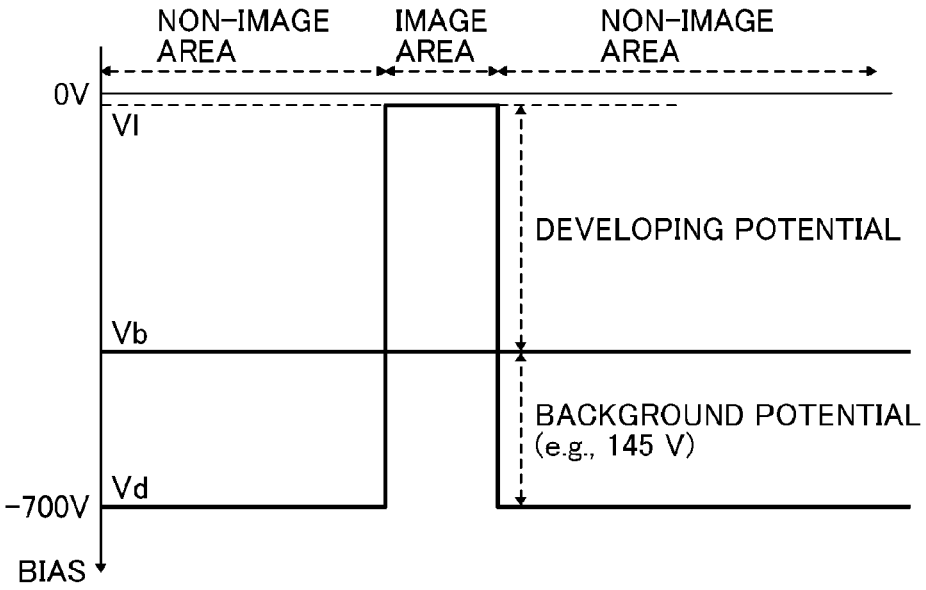
FIG. 7 is a graph of the developing potential and background potential.

FIG. 7 is a graph of the developing potential and background potential.

As illustrated in FIG. 7, the background potential is the difference between the charging potential Vd and the developing bias Vb and acts in the non-image area (the background area). The possibility of occurrence of background fog increases as the background potential decreases, but the possibility of occurrence of adhesion of carrier increases as the background potential increases. Therefore, it is preferred to determine the background potential considering both of background fog and carrier adhesion.

Figure 8:
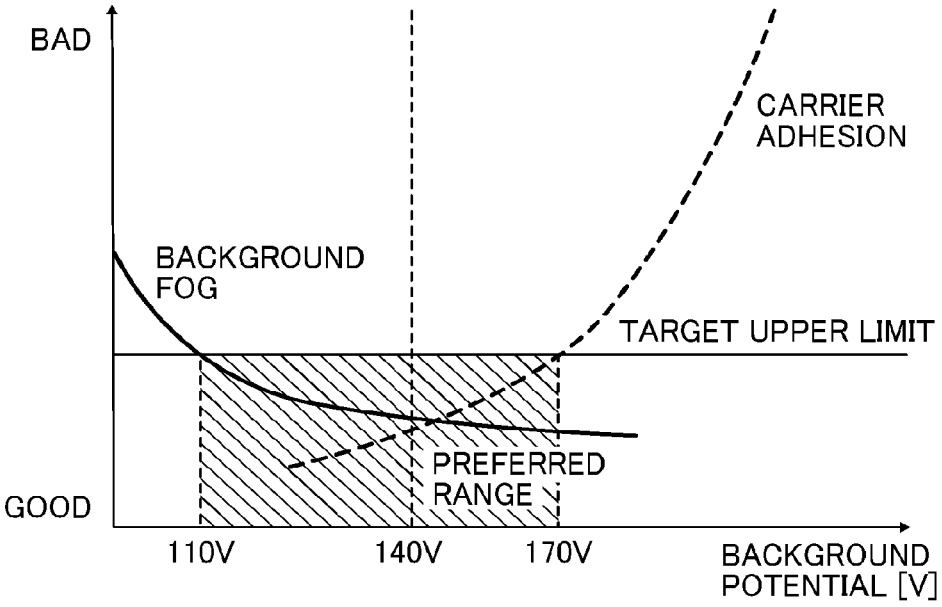
FIG. 8 is a graph illustrating a relation between the background potential and the degree of background fog (stain by adhering toner) and the degree of carrier adhesion.

FIG. 8 is a graph illustrating a relation between the background potential and the degree of background fog and the degree of carrier adhesion.

In this example, a theoretical value of the background potential is set to 140 V based on the process control. The term "theoretical value" is used from the following reason. As described above, in the process control, the background potential is determined based on the relation between the proper charging potential Vd and the developing bias Vb, and the charging bias Vc is determined based on the determined background potential. However, it is possible that the charging potential Vd attained by the charging bias Vc is different from the target charging potential. Since a discharge start voltage, at which electrical discharge starts between the charging roller 3 and the photoconductor 2, varies depending on various factors, the charging bias Vc to attain the charging potential Vd varies accordingly. In the process control, although the environment and the photoconductor running distance are considered to determine the charging bias Vc, the theoretical value calculated based on the algorithm does not always match actual conditions. Additionally, the value of the charging bias Vc to attain the same charging potential Vd can vary depending on another parameter different from the environment and the photoconductor running distance.

In the example illustrated in FIG. 8, both of background fog and carrier adhesion are inhibited when the background potential is about 140 V. Therefore, in the process control, the controller 30 determines the target charging potential to attain a background potential of, for example, 140 V and a desirable developing potential. However, the charging bias Vc determined in the process control does not necessarily attain the target charging potential because the charging bias Vc to attain the charging potential Vd fluctuates depending on various factors. In some cases, the actual charging potential Vd can significantly deviate from the target charging potential (140 V in FIG. 8). In that case, in FIG. 8, it is possible that the actual background potential exceeds 170 V and carrier adhesion occurs, or the actual background potential falls below 110 V and background fog occurs. That is, in FIG. 8, a preferred range of the background potential is from 110 V to 170 V.

Figure 9:
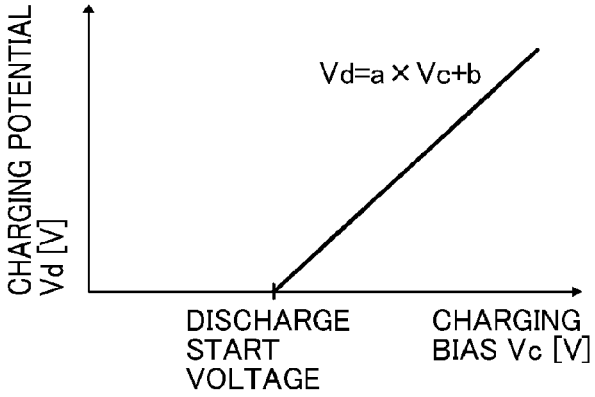
FIG. 9 is a graph illustrating a relation between a charging potential and a charging bias.

As described above, the charging bias Vc is applied to the charging roller 3, which is a rubber roller. As illustrated in FIG. 9, the charging potential Vd of the photoconductor 2 exhibits the characteristic:

$$Vd=a\times Vc+b,$$

wherein "a" represents the inclination of the graph illustrated in FIG. 9, and "b" represents the intercept of the y-axis representing the charging potential Vd in FIG. 9. The y-axis intercept in the graph is almost equal to the discharge start voltage between the charging roller 3 and the photoconductor 2. Additionally, the inclination a is almost equal to 1.

Figure 10:
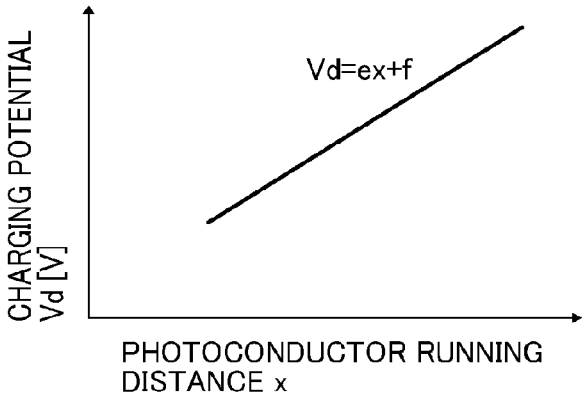
FIG. 10 is a graph illustrating a relation between the charging potential and photoconductor running distance.

As described above, the image forming apparatus 100 employs the contact-type DC charging, in which the charging bias Vc including the DC bias without an AC component is applied to the charging roller 3 in contact with the photoconductor 2. Differently from a charging method in which the charging bias is a superimposed bias including an AC component and a DC component, the contact-type DC charging does not requires an AC power supply, and thus the cost is lower. Meanwhile, since an alternating electrical field is not generated between the charging roller 3 and the photoconductor 2, unless the charging bias Vc is greater than the discharge start voltage illustrated in FIG. 8, discharging does not occur between the charging roller 3 and the photoconductor 2. Then, the photoconductor 2 is not charged at all. Even if the photoconductor 2 is charged, the charging potential Vd fluctuates under the same charging bias Vc because the discharge start voltage changes depending on the environment, the abrasion amount of the photoconductor 2, the electrical resistance of the charging roller 3, and the stain on the charging roller 3. Accordingly, it is difficult to keep the charging potential Vd at a desirable value compared with AC charging. FIG. 10 is a graph illustrating a relation between the charging potential Vd and the photoconductor running distance. In FIG. 10, reference character "x" represents the photoconductor running distance. The photoconductor running distance x represents an accumulative value by which the surface of the photoconductor 2 moves as the photoconductor 2 rotates. As illustrated in FIG. 10, the charging potential Vd exhibits the characteristic expressed as:

$$Vd=ex+f,$$

wherein e represents the inclination of the graph in FIG. 10, and f represents the intercept of the y-axis representing the charging potential Vd. The inclination e and the intercept f are not constant and vary at random with elapse of time from the following reasons. Since the cleaning blade and developer rub against the surface of the photoconductor 2, the surface layer of the photoconductor 2 is abraded with the elapse of time. As the amount of abrasion increases, the capacitance of the photoconductor 2 increases gradually. Accordingly, the discharge start voltage falls, and the charging potential Vd rises. Additionally, the amount of abrasion varies depending on various factors such as image area, image shape, environment, and carrier adhesion. For example, when the image is shaped like a vertical ribbon, that is, the image is present only in a portion in the main scanning direction, the photoconductor 2 is abraded in the portion to contact the image. In addition, the stain on the surface of the charging roller 3, which is caused by toner and additives to toner, varies at random, and the discharge start voltage varies accordingly. From those reasons, the inclination e and the intercept f vary at random with elapse of time. It is difficult to arithmetically calculate the charging potential Vd due to the above-described reasons and the fact that directly measuring the abrasion amount of the surface layer of the photoconductor 2 is not available.

By contrast, in electrophotography, it is preferred to control the exposure (the intensity of light to write latent images) to stabilize image density. When the exposure exceeds an optimum value, dot diameter and line width increase, and image shape is blurred in halftone portions. When the exposure falls below the optimum value, white voids (toner is partly absent) occurs in highlight portions.

Figure 11:
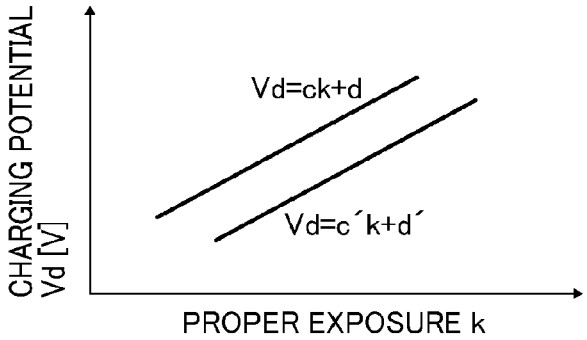
FIG. 11 is a graph illustrating a relation between the charging potential and an optimum value of exposure.

FIG. 11 is a graph illustrating a relation between the charging potential Vd and the optimum value of the exposure ("proper exposure k" in FIG. 11). In the initial stage of use of the photoconductor 2, the charging potential Vd exhibits the relation expressed as:

$$Vd=ck+d,$$

wherein c represents the inclination of the graph in FIG. 11, and d represents the intercept of the y-axis representing the charging potential Vd. In a case where the exposure is kept constant, it is necessary to stabilize the charging potential Vd to attain a desirable image density. Additionally, as the photoconductor 2 ages, the relation between the charging potential Vd and the proper exposure k changes to: Vd=c'k+d'. Therefore, keeping the exposure constant is not sufficient to maintain the desirable image density.

Figure 12:
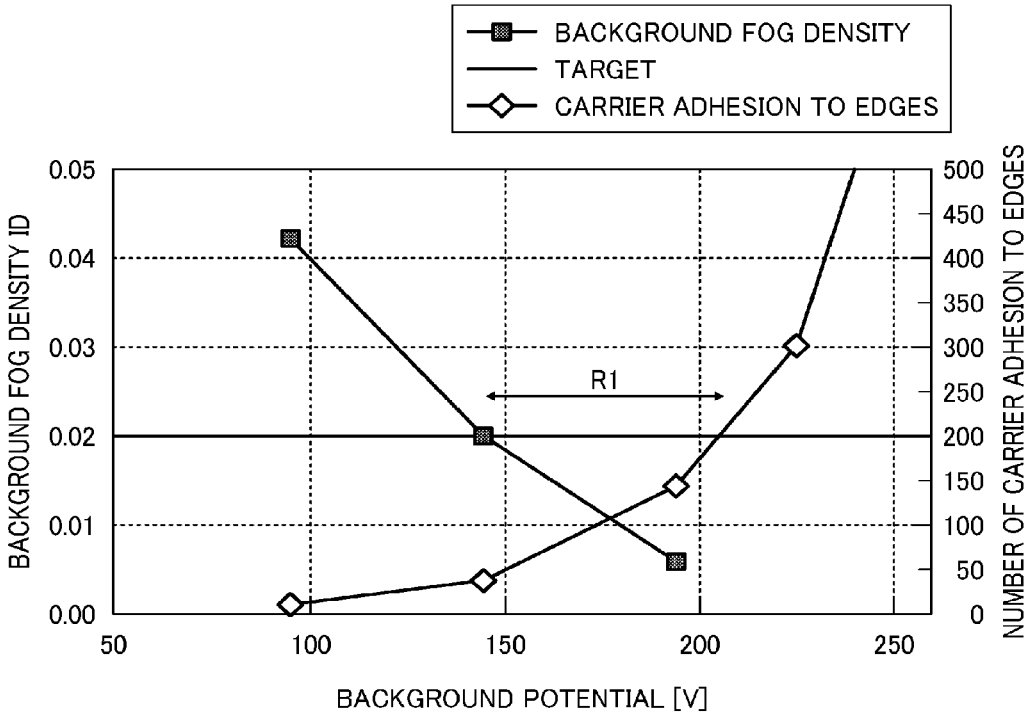
FIG. 12 is a graph illustrating a relation between background fog density, background potential, and carrier adhesion to image edges on a photoconductor.

FIG. 12 is a graph illustrating a relation between a background fog density (image density or ID), the background potential, and carrier adhesion to edges (the amount of carrier adhering to the photoconductor 2).

To obtain the background fog density (ID), toner adhering to the background area on the photoconductor 2 is transferred onto a piece of adhesion tape, and the image density on the adhesion tape is measured as the background fog density. To obtain the carrier adhesion to edges (i.e., image edges on the photoconductor 2), a test image including a large area in which edges are emphasized is formed, and magnetic carrier particles adhering to the edges or areas adjacent to edges of the test image on the photoconductor 2 are counted. As illustrated in FIG. 12, the background fog density (ID) increases as the background potential decreases. By contrast, the carrier adhesion to edges increases as the background potential increases. In the graph, an optimum value of the background potential is about 180 V. Unless the background potential is kept at the optimum value ±30 V (i.e., a preferred range R1 in FIG. 12), the background fog and the carrier adhesion occur. Although the optimum value varies depending on apparatus type, the variation of the optimum value is small in apparatuses of same type.

Therefore, the controller 30 is configured to adjust the charging bias Vc to attain the target charging potential, as required, after performing the process control.

Figure 13:
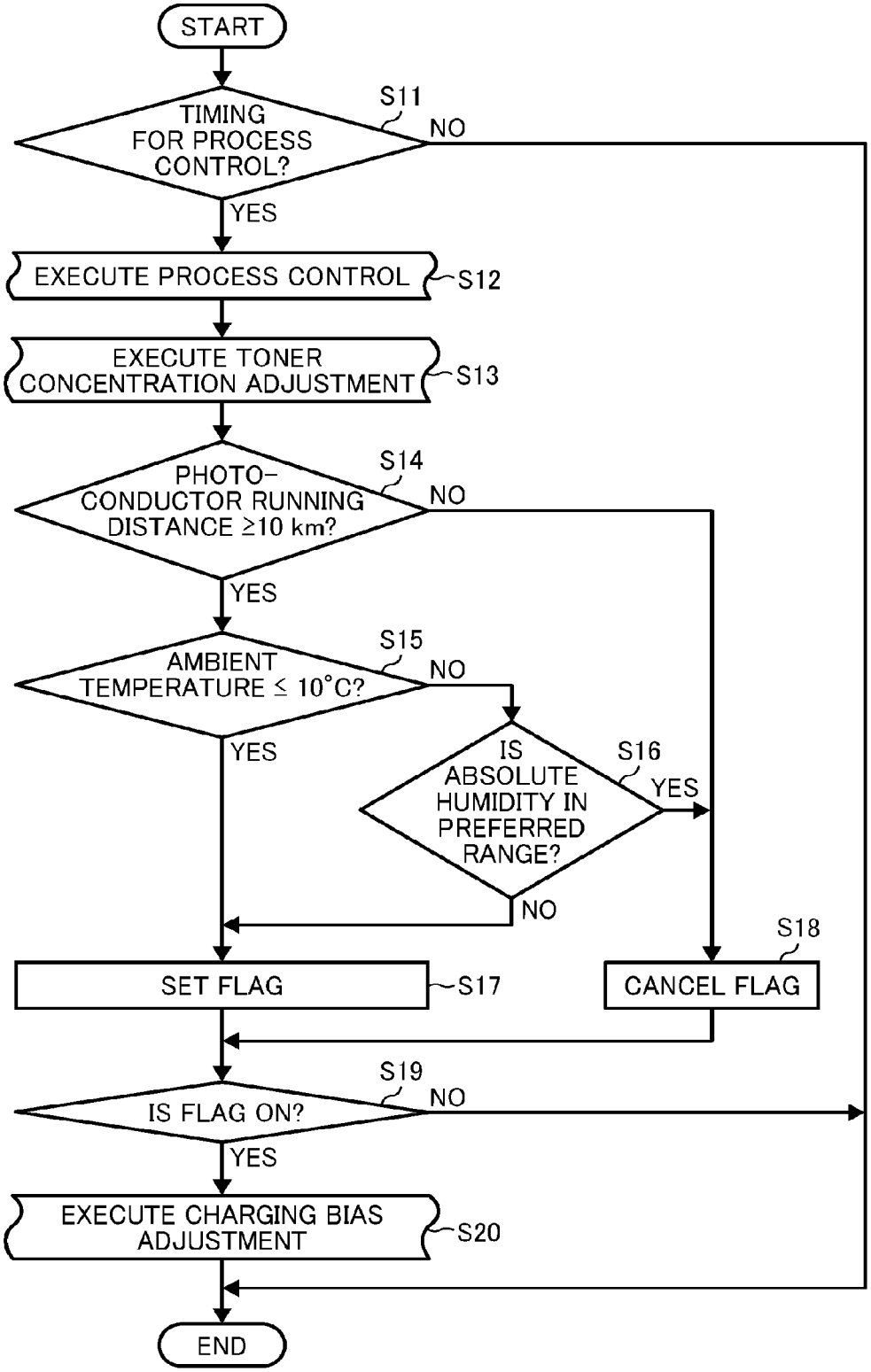
FIG. 13 is a flowchart of regular routine processing of a controller of the image forming apparatus illustrated in FIG. 1.

FIG. 13 is a flowchart that illustrates a flow of regular routine processing of the controller 30 according to the present embodiment. In the regular routine processing, at S11, the controller 30 determines whether or not the predetermined timing for process control arrives. When it is not the predetermined timing for process control (No at S11), the regular routine processing completes. When it is the predetermined timing for process control (Yes at S11), the process proceeds to step S12.

At S12, the controller 30 executes the above-described process control. It is to be noted that, when consecutive printing is ongoing before the start of the process control, the printing is suspended to start the process control.

After the process control, at S13 the controller 30 executes toner concentration adjustment in which the toner concentration of developer contained in each of the developing devices 4Y, 4C, 4M, and 4K is adjusted. Since the target toner concentration is changed in the process control in some cases, the toner concentration is adjusted after the process control. When the toner concentration detected by the toner concentration sensor is lower than the target concentration, toner is supplied to the developer in the developing devices 4. When the detected toner concentration is higher than the target concentration, a toner image for toner consumption is developed, thereby forcibly consuming toner.

After the toner concentration adjustment completes, the controller 30 determines whether charging bias adjustment is necessary. It is experientially known that the charging potential Vd deviates from the target charging potential determined in the process control when the photoconductor running distance reaches a threshold and that the deviation is ignorable until the photoconductor running distance reaches the threshold. In the example illustrated in FIG. 13, the threshold is set to 10 km. At S14, the controller 30 determines whether or not the photoconductor running distance is equal to or greater than 10 km (the threshold). When the photoconductor running distance is smaller than 10 km (No at S14), at S18 the controller 30 cancel the flag and proceeds to Step S19. At S19, the controller 30 determines that the flag is off (No at S19) and completes the regular routine processing.

It is also experientially known that, even when the photoconductor running distance reaches the threshold, the deviation of the charging potential Vd from the target charging potential is relatively small depending on the environment. Specifically, when the temperature is at or lower than a threshold temperature, the deviation is large, requiring charging bias adjustment. Further, even when the temperature is higher than the threshold temperature, the deviation is large if the absolute humidity is out of a preferred range. Then, the charging bias Vc is adjusted. In other cases, since the deviation is relatively small, the charging bias Vc is not adjusted.

Accordingly, when the photoconductor running distance is equal to or greater than 10 km (Yes at S14), at S15 the controller 30 determines whether or not the ambient temperature is equal to or lower than the threshold temperature (e.g., 10° C. in FIG. 13). When the ambient temperature is equal to or lower than 10° C. (Yes at S15), at S17 the controller 30 sets the flag and proceeds to S19. At S20, the controller 30 executes the charging bias adjustment. When the temperature is higher than 10° C. (No at S15), at S16 the controller 30 determines whether or not the absolute humidity detected by the environment detector 52 is in the preferred range. For example, the controller 30 determines whether the absolute humidity is in a range of from 5 mg/m$^3$ to 18 mg/m$^3$ (within the preferred range). When the absolute humidity is out of the preferred range (No at S16), the process proceeds to Steps S17 and S19. As the flag is on (Yes at S19), the controller 30 executes the charging bias adjustment. When the detected absolute humidity is within the preferred range (Yes at S16), the process proceeds to Steps S18 and S19. As the flag is off (No at S19), the controller 30 completes the regular routine processing without executing the charging bias adjustment.

Thus, the controller 30 determines the timing to adjust the charging bias Vc based on the photoconductor running distance and the detection result (temperature and humidity) by the environment detector 52, thereby preventing unnecessary adjustment of the charging bias and reducing the downtime of the apparatus. It is to be noted that, when the charging bias adjustment is executed, the regular routine processing can be completed after again executing the toner concentration adjustment.

In the charging bias adjustment, the controller 30 executes the following processing to form a background fog pattern for each color on the intermediate transfer belt 7. Initially, in a state in which the optical writing unit 6 is deactivated (that is, a latent image is not to be formed), while rotating the photoconductor 2, the controller 30 changes the charging bias Vc stepwise to form multiple sections different in charging potential Vd (serving as different positions having different potentials) on the surface of the photoconductor 2 in the circumferential direction (in a shape of arc) thereof. As the photoconductor 2 rotates, those sections pass through the developing position. Then, the background fog pattern including the multiple sections different in the amount of background fog is formed on the photoconductor 2 due to the difference in the background potentials. Thus, while the multiple sections on the photoconductor 2 different in potential pass through the developing gap facing the developing roller 4*a*, toner adheres to each section in the amount corresponding to the potential of that section, thereby forming the background fog pattern.

The background fog pattern is transferred onto the intermediate transfer belt 7. It is to be noted that the background fog patterns of different colors are transferred at positions not overlapping with each other in the belt travel direction YA.

Figure 14:
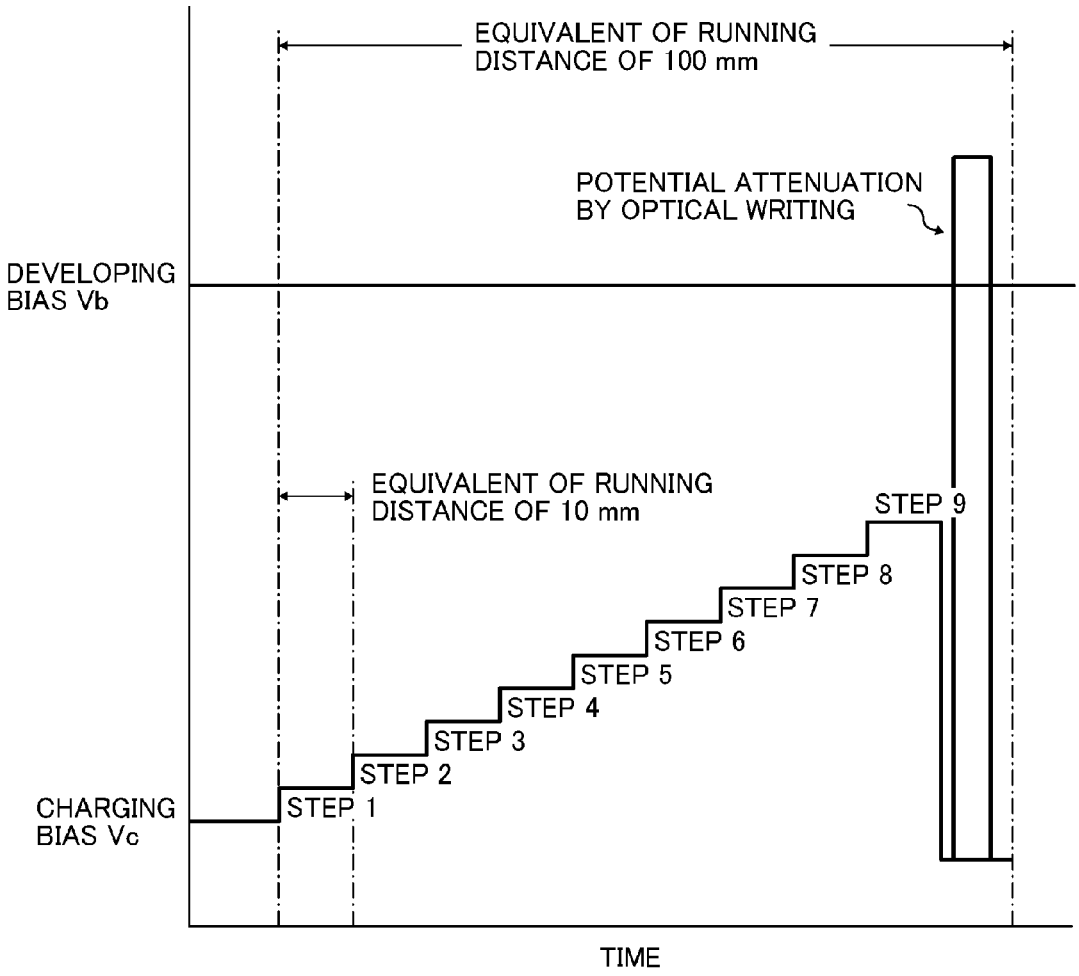
FIG. 14 is a graph illustrating potential changes with elapse of time in formation of a yellow background fog pattern.

FIG. 14 is a graph illustrating different potentials generated stepwise with time to form the background fog pattern in the image forming unit 1Y.

In forming the background fog pattern for yellow, the controller 30 changes the charging bias Vc stepwise while keeping the developing bias constant. In the example illustrated in FIG. 14, in a configuration in which the distance between image forming stations is 100 mm, the charging bias Vc is changed in nine steps (Step 1 through Step 9) for each period equivalent to a running distance of 10 mm of the photoconductor 2. Since both of the developing bias Vb and the charging bias Vc have negative polarity in the present embodiment, the absolute values of the biases become greater as the position in FIG. 14 descends. For example, at the initial step (Step 1) of the nine steps, the charging bias Vc is a DC bias of −1350 V. Subsequently, the controller 30 reduces the charging bias Vc by 20 V each time the time equivalent to the photoconductor running distance of 10 mm elapses. That is, the charging bias V is −1330 Vat Step 2 and −1310 Vat Step 3.

The yellow background fog pattern formed on the photoconductor 2Y is transferred onto the intermediate transfer belt 7 in the primary transfer nip. Similarly, the cyan, magenta, and black background fog patterns are transferred onto the intermediate transfer belt 7.

While forming the background fog patterns, the controller 30 acquires the outputs from the reflective photosensors 20*a*, 20*b*, 20*c*, and 20*d* and stores the outputs in the RAM 30*b*, timed to coincide with arrival of the background fog patterns at the position (detection position) facing the optical sensor unit 20. The controller 30 then acquires the toner adhesion amount (background fog toner amount) based on the mean value of the output values for each section. Subsequently, based on the background fog toner amounts and the values of the charging bias Vc of the sections corresponding to the background fog toner amounts, the controller 30 determines the value of the charging bias Vc to keep the background fog density within a tolerable range. Based on the specified value, the controller 30 computes a charging bias correction value. Then, the controller 30 renews the setting of the charging bias Vc for printing operation to a value adjusted with the charging bias correction value. With this control, the surface of the photoconductor 2 is charged approximately to the target charging potential to secure the desired background potential, thereby inhibiting background fog and carrier adhesion.

In printing operation, when instructing the charge power unit 50 to output the charging bias Vc, the controller 30 sends a signal corresponding to the setting of the charging bias Vc. Then, the charge power unit 50 outputs the charging bias Vc identical to the setting. It is to be noted that the value of the charging bias Vc applied to the charging roller 3 from the charge power unit 50 can be independent for each of yellow, cyan, magenta, and black.

Figure 15:
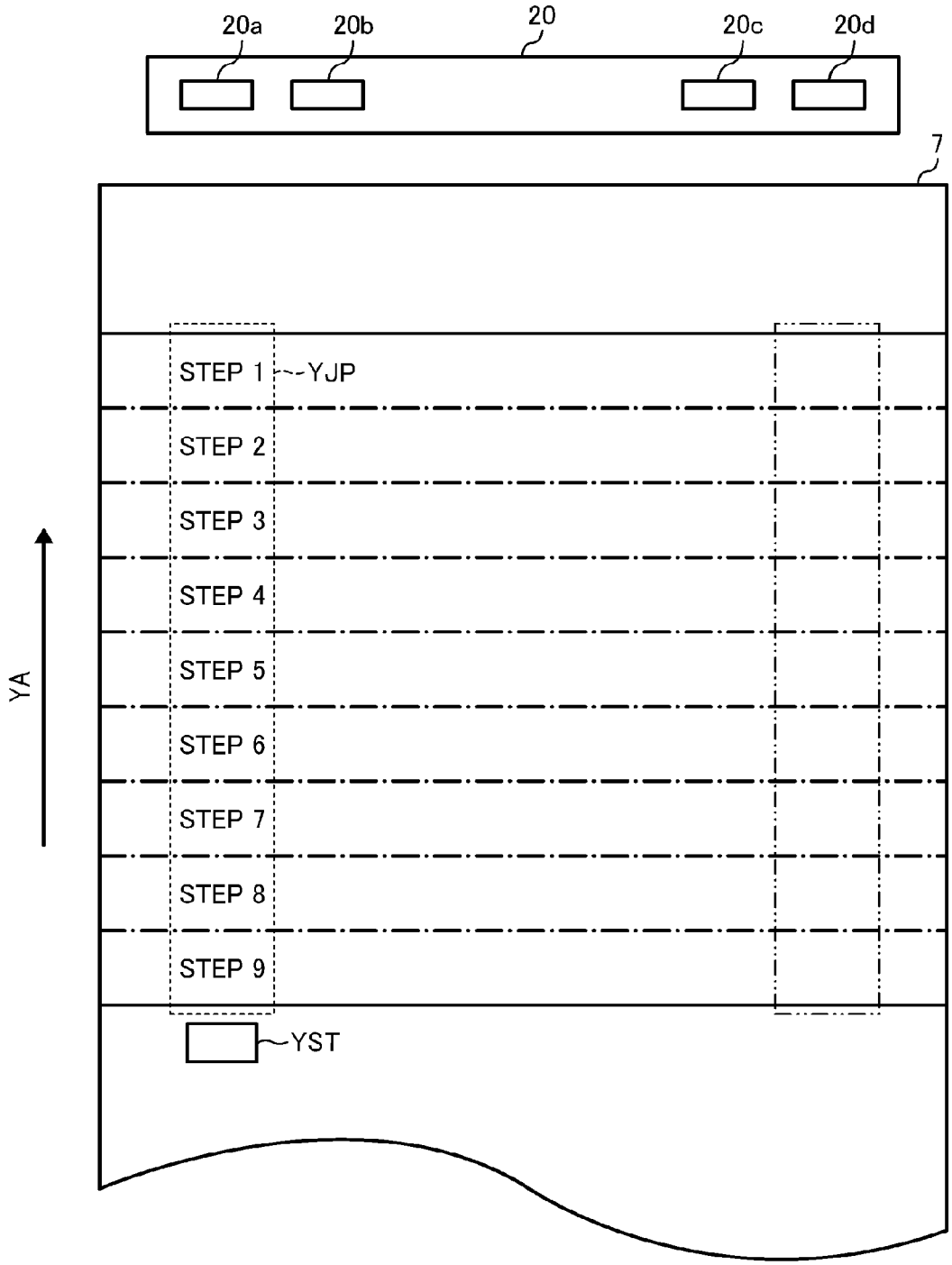
FIG. 15 is a plan view illustrating the yellow background fog pattern on the intermediate transfer belt.

FIG. 15 is a plan view illustrating the background fog pattern for yellow, given reference character "YJP" on the intermediate transfer belt 7.

In FIG. 15, for ease of understanding, the borders of the sections of the yellow background fog pattern YJP are indicated by alternate long and short dashed lines. It is to be noted that, in the present embodiment, it is not necessary that the background fog pattern extends entirely in the belt width direction. It is sufficient that the background fog pattern is present only in the range detected by the reflective photosensors 20*a*, 20*b*, 20*c*, and 20*d* out of the entire range in the belt width direction. Other ranges than the detected range can be the background without the background fog pattern. In practice, the background fog is caused entirely in the belt width direction, and a toner image according to image date is not formed on the intermediate transfer belt 7. However, in FIG. 15, a portion in the belt width direction is enclosed with broken lines and given reference "YJP" to indicate the area in which the background fog pattern is present. Specifically, since the first reflective photosensor 20*a*, out of the four reflective photosensors 20*a*, 20*b*, 20*c*, and 20*d*, detects the toner adhering amount of the yellow background fog pattern YJP in the present embodiment, only the range that passes through the position under the first reflective photosensor 20*a* is regarded as the yellow background fog pattern YJP as indicated by broken lines in FIG. 15. In a configuration in which the fourth reflective photosensor 20*d* is used to detect the toner adhering amount of the yellow background fog pattern YJP, the yellow background fog pattern YJP is disposed in the range indicated by the chain double-dashed line in FIG. 15 (on the right in FIG. 15).

As illustrated in FIG. 15, in the present embodiment, a yellow toner image YST for locating is formed immediately following the yellow background fog pattern YJP. To form an electrostatic latent image of the yellow toner image YST for locating, as illustrated in FIG. 14, after the charging bias Vc at Step 9 is applied to the charging roller 3, optical writing is executed on the photoconductor 2 with the absolute value of the charging bias Vc made greater than the charging bias Vc at Step 1.

The controller 30 starts sampling slightly earlier than a theoretical timing (a calculated time value) at which the yellow background fog pattern YJP reaches the position (detection position) under the first reflective photosensor 20*a*. The controller 30 samples the outputs from the first reflective photosensor 20*a* and stored the sampled output at high-speed cycles (time intervals). A timing at which the output from the first reflective photosensor 20*a* changes significantly is stored as the timing at which the yellow toner image YST for locating arrives at the position under the first reflective photosensor 20*a*. Simultaneously, the controller 30 completes the sampling. The controller 30 then segments the sampled data values in time series and constructs a group of sampled data values corresponding to each section of the yellow background fog pattern YJP. Constructing the group of sampled data values is equivalent to determining the timing at which each section arrives at the detection position.

After constructing the group of sampled data values for each section, the controller 30 computes the toner adhesion amount in each section.

Similar to yellow, for each of cyan, magenta, and black, a toner image for locating is formed immediately following the background fog pattern, and a group of sampled data values is constructed based on the timing at which the toner image for locating is detected. It is to be noted that the background fog pattern of each of yellow, cyan, and magenta can be disposed at any position in the belt width direction as long as the position is detected by one of the first, second, and fourth reflective photosensors 20*a*, 20*b*, and 20*d*. However, in the present embodiment, the background fog pattern of each of yellow, cyan, and magenta is disposed at the position detected by either the first reflective photosensor 20*a* or the fourth reflective photosensor 20*d* due to the reason described later.

Additionally, the background fog pattern of black is disposed at the position detected by any one of the four reflective photosensors (20*a*, 20*b*, 20*c*, and 20*d*) in the belt width direction because the black toner adhesion amount can be computed using the output based on only the specular reflection of light even when the first, second, or fourth reflective photosensor 20*a*, 20*b*, or 20*d* is used. However, in the present embodiment, the background fog pattern of black is also disposed at the position detected by either the first reflective photosensor 20*a* or the fourth reflective photosensor 20*d* due to the reason described later.

When the toner image for locating, for which adhesion of toner to the electrostatic latent image is actively promoted with the developing potential, arrives at the position detected by the reflective photosensor (20*a* or 20*d* in the present embodiment), the sensor output changes significantly. Therefore, the timing at which the toner image for locating arrives at the detection position can be measured precisely based on the changes in the sensor output. The time difference between the arrival timing (i.e., a first timing) of the toner image for locating and the arrival timing (i.e., a second timing) of each section of the background fog pattern is significantly smaller than the time difference between the timing at which stepwise change of the charging bias Vc is started to form the background fog pattern and the timing at which each section of the background fog pattern arrives at the detection position. Since the time difference is smaller, the arrival timing can be detected accurately, differently from a case where the timing at which each section arrives at the detection position is determined based on the timing at which the stepwise change of the charging bias Vc is started. This configuration suppresses the occurrence of background fog and carrier adhesion resulting from low accuracy in determining the arrival timing of each section of the background fog pattern at the detection position.

In the present embodiment, the distance between the image forming stations is set to 100 mm. The distance between the image forming stations means the arrangement pitch of the image forming units 1 adjacent to each other in the belt travel direction and equivalent to the distances between the adjacent primary transfer nips. In the belt travel direction YA, the length starting from the leading end of the background fog pattern to the trailing end of the toner image for locating is shorter than the distance (100 mm, for example) between the image forming stations. With this setting, the background fog patterns of the four colors do not overlap even when the positions thereof are identical in the belt width direction. Further, formation of the background fog patterns of the four colors can be started almost simultaneously to shorten the duration of the charging bias adjustment.

Figure 16:
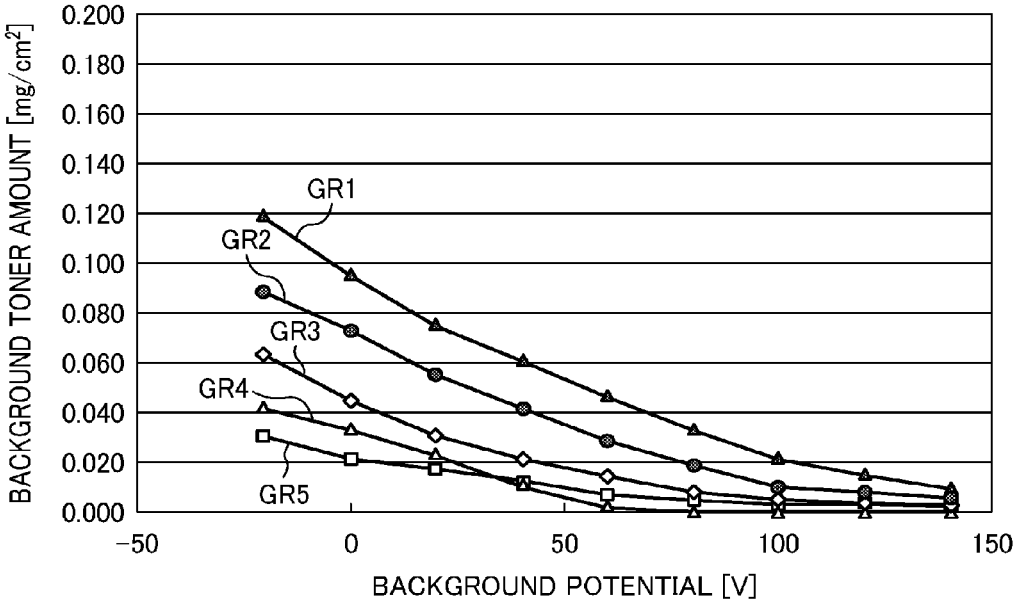
FIG. 16 is a chart illustrating relations between the amount of background fog toner and the background potential in multiple sections of the background fog pattern.

FIG. 16 is a chart illustrating relations between the amount of background fog toner and the background potential in the multiple sections (the background potentials acting therein are different) of the background fog pattern.

The chart in FIG. 16 includes multiple graphs GR1, GR2, GR3, GR4, and GR5 that connect different shape plots. Those graphs represent the results of an experiment executed using the image forming units different in photoconductor running distance. As illustrated in FIG. 16, the characteristics represented by the graphs GR1, GR2, GR3, GR4, and GR5 are different depending on the image forming unit. In the image forming unit from which the graph GR1 (on the top in FIG. 16, connecting solid triangular plots) was derived, a large amount of background fog toner was generated with a relatively low background potential. This result suggests that the background fog easily occurs in that image forming unit since the developer has deteriorated and the toner charge amount per toner mass (Q/M) is lower, or the discharge start voltage is higher and the charging potential Vd is lower than the target charging potential. In such an image forming unit, to suppress the occurrence of background fog, it is necessary to increase the absolute value of the charging bias Vc (in the negative polarity) to rise the charging potential Vd.

By contrast, in the image forming unit from which the graph GR5 (on the bottom in FIG. 16, connecting outlined square plots) was derived, the amount of background fog toner was smaller even when the background potential was relatively high. This result suggests that the carrier adhesion easily occurs in that image forming unit since the discharge start voltage is relatively lower and the charging potential Vd is higher than the target charging potential. In such an image forming unit, to suppress the occurrence of carrier adhesion, it is necessary to reduce the absolute value of the charging bias Vc (in the negative polarity) to lower the charging potential Vd.

Figure 17:
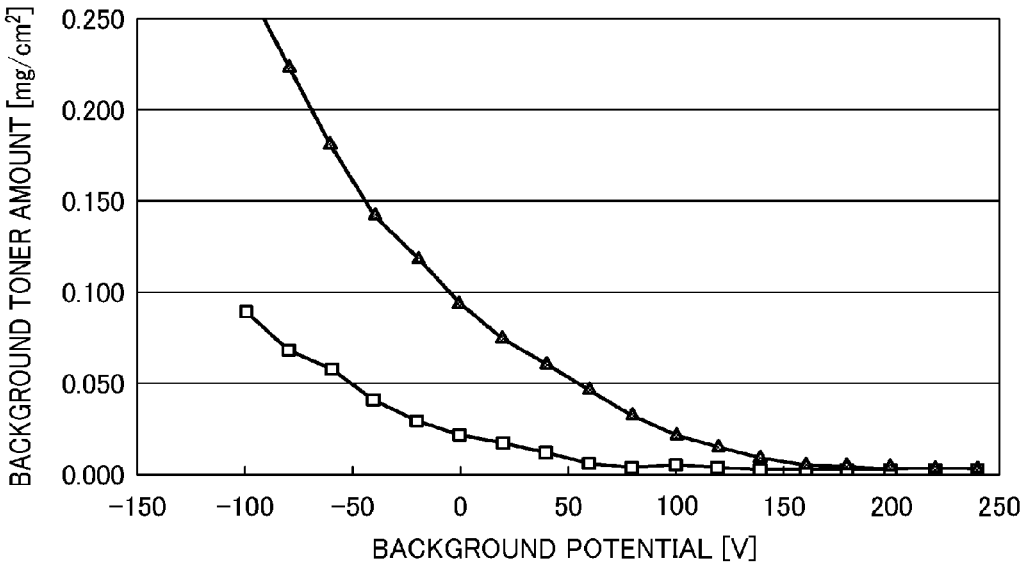
FIG. 17 is a chart illustrating characteristic curves between the background fog toner amount and the background potential and the inclination of straight lines approximated from the characteristic curves.

FIG. 17 is a chart illustrating characteristic curves between the background fog toner amount and the background potential and the inclination of straight lines approximated from the characteristic curves.

FIG. 17 includes two characteristic curves representing the relation between the background fog toner amount and the background potential. Each of the two characteristic curves connects all plots regarding the image forming unit with which experiment data is derived. To compute the charging bias correction value, not such a characteristic curve but the approximate straight line thereof is used. Of the approximate straight line, only a range in which the background fog toner amount is moderate is used, which is described in detail later. Accordingly, it is necessary to obtain an approximate straight line having a proper inclination in the range in which the background fog toner amount is moderate (hereinafter "moderate adhesion range"). However, if most of the characteristic curve extends in a range in which the background fog toner amount is relatively large (hereinafter "high adhesion range") like the upper graph in FIG. 17, the characteristic curve rises on the high adhesion range side. In this case, in the moderate adhesion range, the approximate straight line has an inclination greater than an optimum value. If most of the characteristic curve extends in a range in which the background fog toner amount is relatively small (hereinafter "low adhesion range"), like the lower graph in FIG. 17, the characteristic curve lies on the low adhesion range side. In this case, in the moderate adhesion range, the approximate straight line has an inclination smaller than the optimum value.

In view of the foregoing, from the group of sampled data values corresponding to each section of the background fog pattern, the controller 30 extracts only data values with which the background fog toner amount within a predetermined range (from a lower limit to an upper limit) is obtained. Then, the controller 30 computes the approximate straight line based on the extracted data values. It is to be noted that, in a case where the number of sampled data values is two or smaller, the controller 30 ends the charging bias adjustment since linear approximation is not available.

Figure 18:
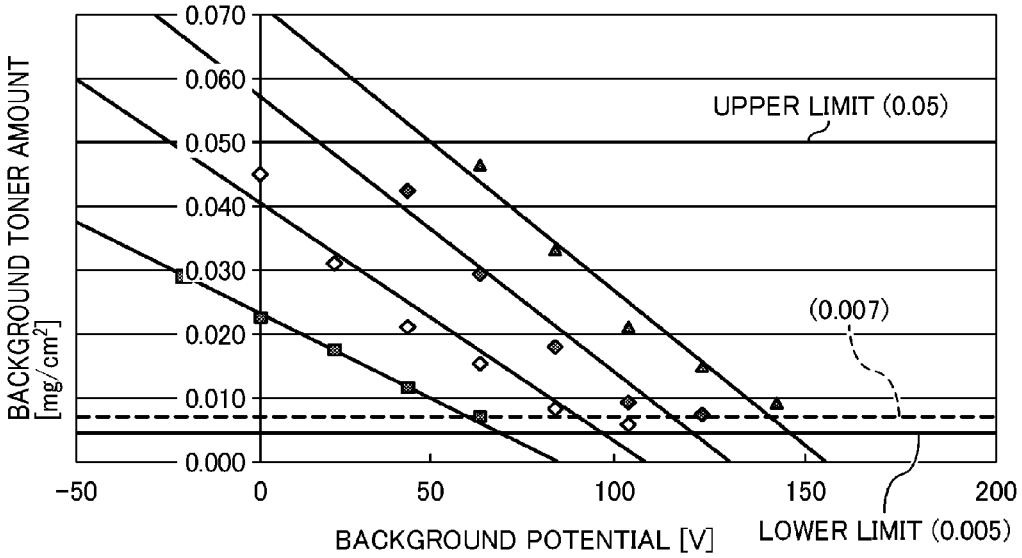
FIG. 18 is a chart illustrating relations between the approximate straight lines and extracted data values.

FIG. 18 is a chart illustrating relations between the approximate straight lines and the extracted data values. In FIG. 18, four approximate straight lines are obtained based on four groups of extracted data values. In each approximate straight line (connecting plots of identical shape), the extracted toner adhesion amounts indicated by the extracted data values are within the range defined by the lower limit and the upper limit. In the present embodiment, the lower limit is 0.005 mg/cm$^2$, and the upper limit is 0.05 mg/cm$^2$.

Subsequently, based on the approximate straight line, the controller 30 determines a background potential that causes a limit-exceeding adhesion amount (indicated by broken lateral line in FIG. 18) as a limit-exceeding background potential $P_1$. The term "limit-exceeding adhesion amount" is an experimentally predetermined constant and means an adhesion amount slightly smaller than the background fog toner amount that keeps the background fog density at a marginal of the tolerable range. The limit-exceeding adhesion amount is between the lower limit and the upper limit. In other words, the lower limit and the upper limit are determined so that the limit-exceeding adhesion amount is interposed therebetween. In the present embodiment, the limit-exceeding adhesion amount is 0.007 mg/cm$^2$ (indicated by broken lateral line).

After determining the limit-exceeding background potential $P_1$, the controller 30 computes a charging bias correction value β according to $$\beta = P_1 - (P_2 - S_1),$$

where $P_2$ represents a theoretical background potential meaning a theoretical value of the background potential adopted in the process control, and $S_1$ represents a predetermined margin. The margin $S_1$ is a constant predetermined experimentally. The margin $S_1$ is deducted from the theoretical background potential $P_2$, thereby obtaining a theoretical limit-exceeding potential, which is a background potential to attain the limit-exceeding adhesion amount under the condition employing the theoretical background potential $P_2$. In other words, what obtained by deducting the margin $S_1$ from the limit-exceeding background potential $P_1$ is a background potential to keep the background fog toner amount reliably within the tolerable range in the current condition. In the formula presented above, the theoretical limit-exceeding potential is deducted from the limit-exceeding background potential $P_1$ to obtain the charging bias correction value β, which is a correction amount to keep the charging potential Vd at or similar to the target charging potential.

In the present embodiment, the margin $S_1$ is about 90 V. Accordingly, in an example where the theoretical background potential $P_2$ is 160 V, the margin $S_1$ is 90 V, and the limit-exceeding background potential $P_1$ is 139 V, the charging bias correction value β is obtained as β=139−(160−90)=69 V. It is to be noted that, the upper limit of the charging bias correction value β is 50 V in the present embodiment, and, when the calculated charging bias correction value β is greater than the upper limit as in this example, the charging bias correction value β is adjusted to 50 V (the upper limit).

Subsequently, the controller 30 deducts the charging bias correction value β from the charging bias Vc determined in the process control, thereby adjusting the charging bias Vc to a value capable of attaining the charging potential Vd identical or similar to the target charging potential. It is to be noted that, when the charging bias correction value β is a positive value, the charging bias Vc is adjusted to a greater absolute value in the negative polarity. Thus, the background potential becomes greater, suppressing the occurrence of background fog. By contrast, when the charging bias correction value β is a negative value, the controller 30 shifts the charging bias Vc to the positive side by the absolute value of the charging bias correction value β. In other words, the charging bias Vc is reduced in absolute value. Then, the background potential becomes smaller, suppressing the occurrence of carrier adhesion. It is to be noted that, when the charging bias correction value β is a negative value, the upper limit of the absolute value thereof is 50. Accordingly, for example, in a case where the calculated charging bias correction value β is −69 V, the charging bias Vc is shifted to the positive side by 50 V.

As described above, in the present embodiment, the charging bias correction value β is determined as follows. Calculate the approximate straight line based on only the sampled data values between the lower limit and the upper limit, setting the limit-exceeding adhesion amount between the lower limit and the upper limit, and determining the charging bias correction value β based on the limit-exceeding background potential $P_1$, the theoretical background potential $P_2$, and the margin $S_1$. In this configuration, even when the coordinates of all sampled data values representing the background fog toner amounts (hereinafter "sampled fog toner amounts") are out of the tolerable range of the background fog density, it is possible to calculate the charging bias correction value β to keep the background fog density within the tolerable range. Accordingly, the background fog pattern is formed without increasing the background potential to a degree that causes carrier adhesion, thereby avoiding the occurrence of carrier adhesion in formation of the background fog pattern.

Next, a distinctive feature of the image forming apparatus 100 according to the present embodiment is described below.

It is assumed that, in the charging bias adjustment, only one of the sampled fog toner amounts in each section of the background fog pattern is significantly different from the proper value due to a local stain or a local flaw. In this case, there is a risk that the calculated approximate straight line represents a wrong relation between the charging bias Vc and the background fog toner amount, and it is possible that the charging bias Vc is adjusted to an improper value.

For example, in the charging bias adjustment, in a case where the charging bias is increased while rotating the photoconductor 2 to form the background fog pattern without writing an electrostatic latent image, the background fog toner amount decreases as the charging bias increases. However, it is possible that the detected toner adhesion amount of a portion of the background fog pattern is erroneously larger than a proper amount because the intermediate transfer belt 7 has a local flaw, stain, or dent or development is locally excessive due to local defect of the developing sleeve or the photoconductor 2. Since the approximate straight line obtained in this case has a smaller inclination of decrease than that represents a proper relation, the calculated charging bias Vc capable of keeping the background fog toner amount at the desirable level would be higher than a proper value. Then, there arises a risk of carrier adhesion, waste of energy, shortening of life of the photoconductor 2.

In view of the foregoing, the controller 30 is configured to execute the following processing before computing the above-described approximate straight line. Initially, sort the sampled data values of each section of the background fog pattern in the order of magnitude (ascending order or descending order) of the charging bias Vc. Specifically, since the value of the charging bias Vc is sequentially increased or decreased in forming the background fog pattern, the controller 30 simply sorts the sampled data values in the sampling order. Then, from the sampled data valued sorted in the sampling order, exclude any data value deviating from monotonicity (monotone decreasing when the charging bias Vc is increased sequentially) because the sampled data value deviating from monotonicity has a large error. When the charging bias Vc is decreased sequentially, exclude any data value deviating from monotone increasing from the sampled data valued sorted in the sampling order. Subsequently, from the remaining sampled data values, extract only data values (the background fog toner amounts) in the range from the lower limit to the upper limit. Then, compute the approximate straight line based on the extracted data values. According to this method, the sampled data value having large error due to local stain or flaw of the intermediate transfer belt 7 is excluded in computing the approximate straight line, thereby more accurately determining the optimum value of the charging bias Vc.

Figure 19:
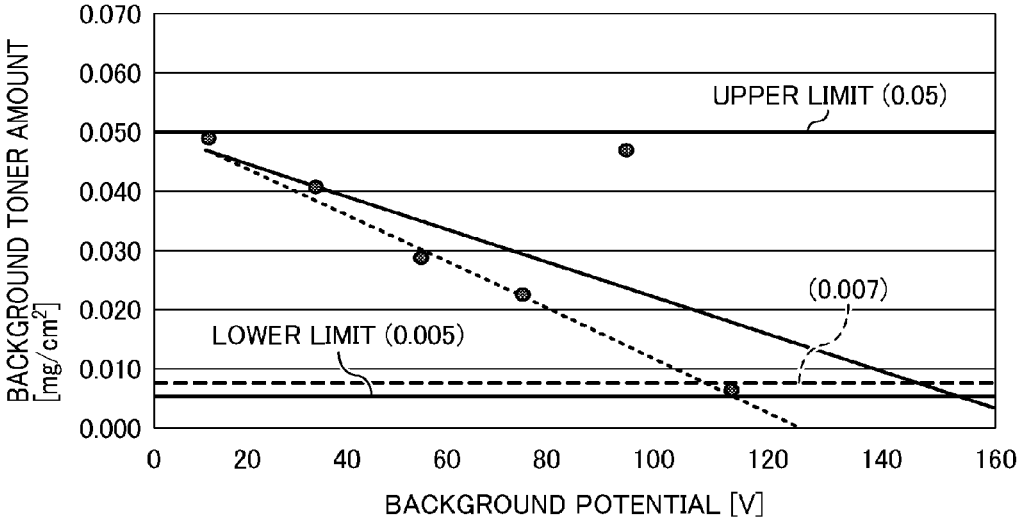
FIG. 19 is a chart illustrating an approximate straight line according to a comparative method and an example approximate straight line according to an embodiment.

FIG. 19 is a chart illustrating an approximate straight line computed according to a comparative method in which a value deviating from monotonicity is not excluded and an example approximate straight line computed according to the present embodiment.

This chart includes six sampled data values (i.e., sampled fog toner amounts), which are sorted in the ascending order of the corresponding background potential. It means that the data values are in the ascending order of the corresponding charging bias Vc. As the charging bias Vc increases, the background potential increases, and the background fog toner amount decreases. Accordingly, both of the comparative approximate straight line (a solid graph) and the approximate straight line (a broken graph) according to the present embodiment have a declining inclination and represent that the background fog toner amount decreases as the background potential increases. Accordingly, the six data values sorted in the descending order of the background potential should exhibit monotone decreasing of the background fog toner amount. However, the fifth data value from the left in FIG. 19 is not in the monotone decreasing and significantly deviates from both of the approximate straight lines. This means that the fifth data value includes a large error. The five data values except the fifth data value are plotted on or adjacent to the broken graph in FIG. 19. It means that the broken graph, which represents the approximate straight line obtained according to the present embodiment, accurately presents the relation between the background fog toner amount and the background potential. By contrast, the solid graph in FIG. 19, representing the comparative approximate straight line, significantly deviates from three of the five data values except the fifth data value. It means that the broken graph, which represents the approximate straight line obtained according to the present embodiment, is more accurately presents the above-mentioned relation than the comparative approximate straight line. Thus, the present embodiment is advantageous in more accurately determining the optimum value of the charging bias Vc.

It is to be noted that the limit-exceeding background potential obtained according to the solid graph is 146 V, whereas the limit-exceeding background potential obtained according to the broken graph is 115 V. Accordingly, the charging bias Vc set according to the comparative method would be higher than the optimum value. Then, there arises a risk of carrier adhesion, waste of energy, shortening of life of the photoconductor 2.

The sampled data values deviating from monotone decreasing or monotone increasing can be excluded as follows. When Mp represents the sampled data value by the charging bias Step 1, M8 represents that by the charging bias Step 2, . . . and M1 represents that by the charging bias Step 9 sequentially in the ascending order of absolute value of the charging bias Vc, any sampled data value that does not satisfy Mn>M(n−1) is excluded. Further, in a case where the value M(n−1) is to be excluded, regarding the data M(n−2), the sampled data values that satisfy Mn>M(n−2) are kept, whereas those do not satisfy Mn>M(n−2) are excluded.

Figure 20:
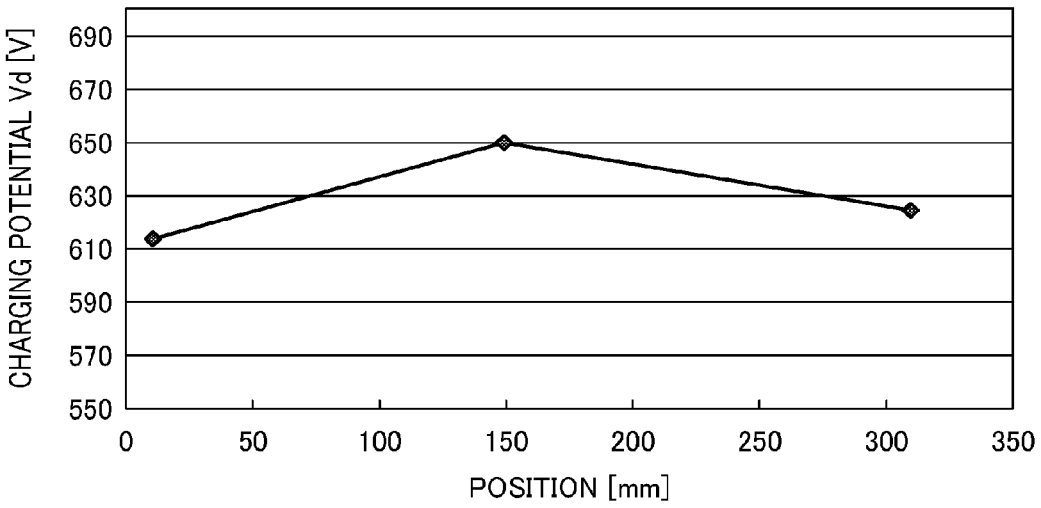
FIG. 20 is a graph illustrating a relation between the charging potential and axial position on a photoconductor that has been driven for a relatively long running distance.

FIG. 20 is a graph illustrating a relation between the charging potential Vd and the position in the axial direction of the photoconductor 2 that has been driven for a relatively long running distance. This graph is plotted based on the values of the charging potential Vd measured by the reflective photosensors disposed at a 10-millimeter position, a 160-millimeter position, and a 310-millimeter position in the axial direction of the photoconductor 2 in a case where an A3-size image width is 300 millimeters and an image formation width is 320 millimeters. In the axial direction of the photoconductor 2, the charging potential Vd is lower in end areas than a center area. Accordingly, the possibility of background fog is higher in the end areas than the center area.

Figure 21:
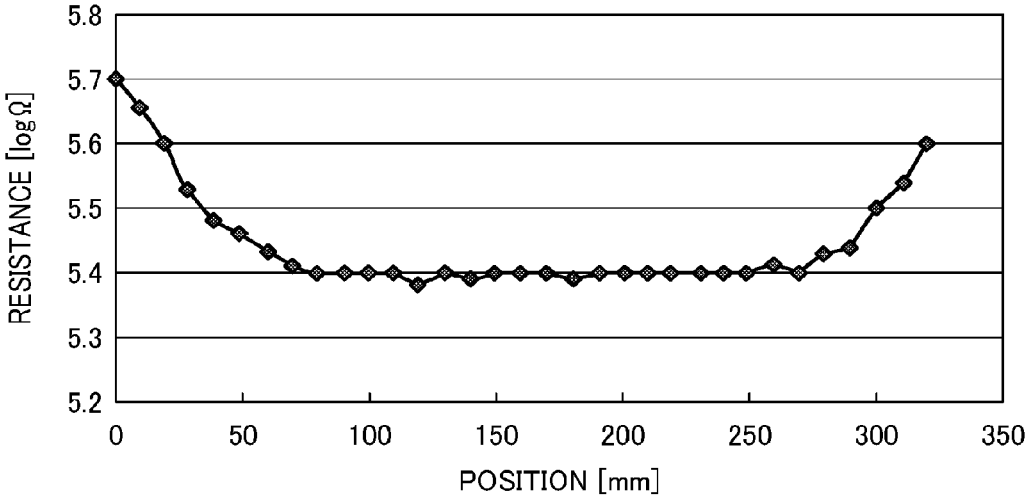
FIG. 21 is a graph illustrating a relation between electrical resistance of a charging roller and axial position on the charging roller in an image forming unit in which the photoconductor has been driven for a relatively long running distance.

FIG. 21 is a graph illustrating a relation between the electrical resistance of the charging roller 3 and the position in the axial direction of the charging roller 3 in the image forming unit in which the photoconductor 2 has been driven for a relatively long running distance. As the photoconductor running distance increases, ends of the charging roller 3 in the axial direction thereof are soiled with silica (an additive to toner), and the electrical resistance at the ends increases more than a center area. Therefore, the charging potential Vd varies between the 10-millimeter position, the 160-millimeter position, and the 310-millimeter position in the axial direction of the photoconductor 2.

In view of the foregoing, in the present embodiment, a combination of the background fog pattern and the toner images for locating of each color is formed in the end areas in the belt width direction, which correspond to the axial end areas of the photoconductor 2 and the charging roller 3. More specifically, for each of yellow, cyan, magenta, and black, the combination of the background fog pattern and the toner image for locating is formed on either the first end side facing the first reflective photosensor 20*a* or the second end side facing the fourth reflective photosensor 20*d* in the belt width. With this placement, the occurrence of background fog is detected at a higher sensitivity.

It is to be noted that, it is preferable that the above-mentioned combination regarding each color is formed in both of the first and second end sides in the belt width direction, the toner adhesion amount is detected in each section of the background fog pattern on both end sides, and the mean value is obtained. With this configuration, the charging bias correction value β is computed more properly.

In the present embodiment, the charging bias Vc ascends stepwise, as illustrated in FIG. 14, in forming the background fog pattern. That is, the absolute value of the charging bias is changed stepwise from a greater value to a smaller value, and the background potential is reduced stepwise. Since the charging bias Vc is in the negative polarity, the absolute value thereof increases as the charging bias Vc descends in FIG. 14. That is, by the setting of the charging bias Vc, the background fog pattern section is formed on the photoconductor 2 sequentially from the section in which the background fog toner amount is smaller. The occurrence of background fog means that, though the amount is small, toner is consumed, and the toner concentration in the developer decreases. Sequentially forming the background fog pattern sections on the photoconductor 2 from the section in which the background fog toner amount is small is intended to gradually lower the toner concentration in the process of forming the background fog pattern from the leading end to the trailing end. This configuration is advantageous in making the background fog toner amount accord with that section without being affected by decreases in toner concentration and detecting the background fog property accurately. Additionally, the toner image for locating, which requires a greater amount of toner, is formed on the back of the background fog pattern in the belt travel direction so that the toner image for locating is developed after the trailing end of the background fog pattern is developed. This is advantageous in avoiding decreases in detection accuracy of the background fog property caused by decreases in toner concentration inherent to developing of the toner image for locating.

Figure 22:
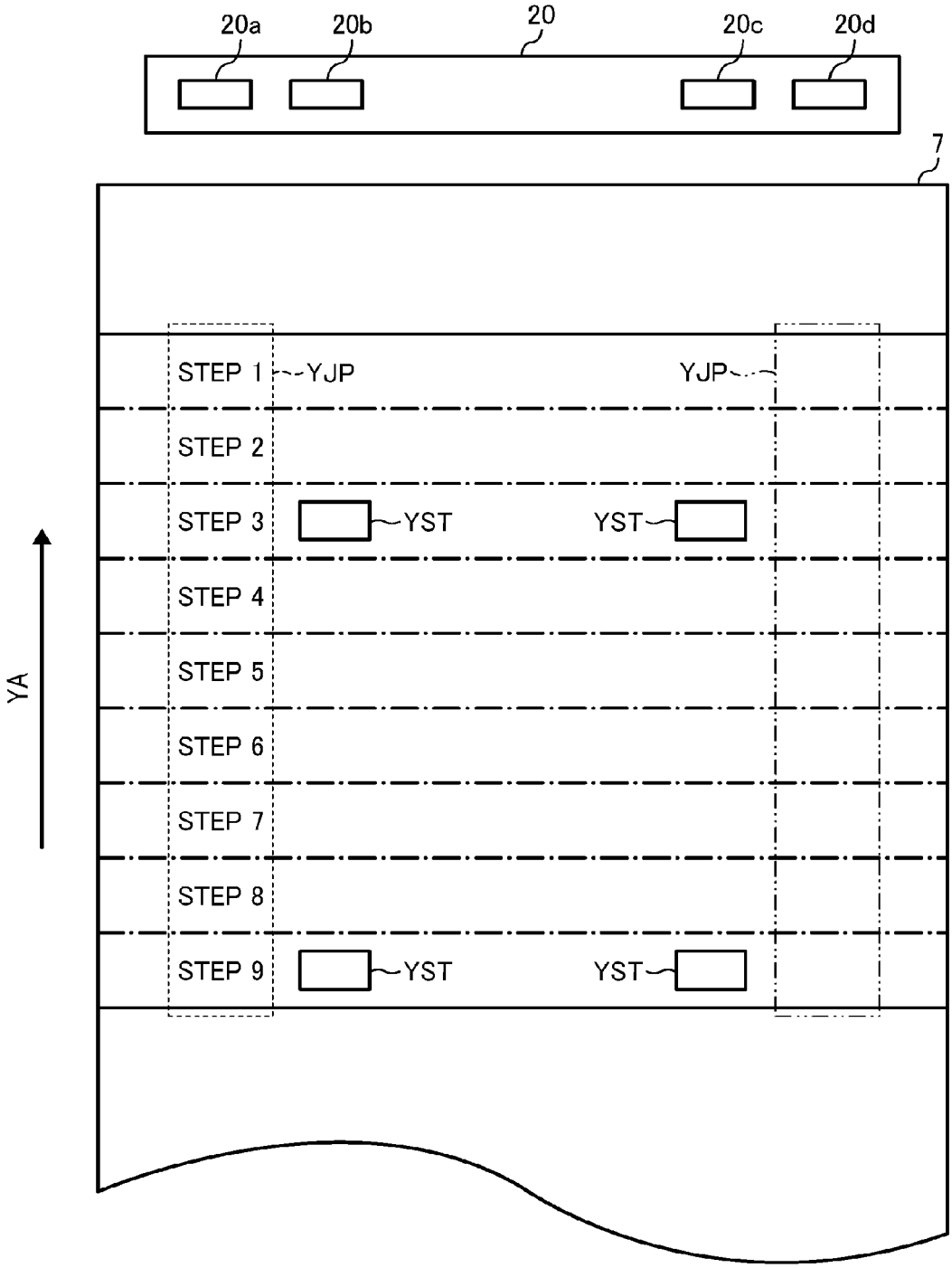
FIG. 22 is a plan view illustrating a variation of the yellow background fog pattern on the intermediate transfer belt.

Additionally, it is not essential that the toner image for locating is disposed on the front or back of the background fog pattern in the belt travel direction. For example, as illustrated in FIG. 22, the yellow toner image YST for locating can be on the side of the yellow background fog pattern YJP in the belt width direction. In the example illustrated in FIG. 22, the yellow toner image YST for locating is disposed on the side of the yellow background fog pattern YJP disposed on the first end side in the belt width direction to pass through the position detected by the first reflective photosensor 20*a*. Based on the timing at which the yellow toner image YST for locating arrives at the position detected by the second reflective photosensor 20*b*, the controller 30 determines the timing at which each section of the yellow background fog pattern YJP on the first end side arrives at the position detected by the first reflective photosensor 20*a*. The controller 30 further determines the timing at which each section of the yellow background fog pattern YJP on the second end side arrives at the position detected by the fourth reflective photosensor 20*d*. In this configuration, the arrival timing of each section can be determined more accurately.

Although the description above concerns the case where the controller 30 changes the charging bias Vc stepwise while keeping the developing bias Vb constant in forming the background fog pattern, alternatively the developing bias Vb can be changed stepwise while keeping the charging bias Vc constant. In this case, the sampled data values are sorted in the ascending order or descending order of the developing bias Vb. That is, regardless of which of the charging bias Vc and the developing bias Vb is changed, the sampled data values are sorted in the ascending or descending order of the background potential, and whether or not the data values exhibit monotonicity (either monotone decreasing or monotone increasing) is determined.

The steps in the above-described flowchart may be executed in an order different from that in the flowchart. Further, any of the aforementioned methods may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

Further, aspects of the present disclosure can adapt to image forming apparatuses employing direct transferring. In direct transferring, toner images are transferred from respective photoconductors and superimposed one on another on a sheet (i.e., a recording medium) carried on a conveyor such as a conveyor belt disposed facing the multiple photoconductors. That is, in the image forming apparatus 100 illustrated in FIG. 1, instead of the intermediate transfer belt 7, a conveyor belt to transport the sheet is disposed facing the photoconductors 2, and the toner image are transferred from the photoconductors 2 onto the sheet carried on the conveyor belt.

According to the above-described embodiment, the optimum value of the charging bias Vc is determined more accurately.

The configurations described above are just examples, and each of the following aspects of this specification attains a specific effect.

Aspect A

An image forming apparatus includes a latent image bearer (e.g., the photoconductor 2Y), a charger (e.g., the charging roller 3Y) to charge the surface of the latent image bearer that rotates, a charge power supply (e.g., the charge power unit 50) to output a charging bias applied to the charger, a latent-image writing device (e.g., the optical writing unit 6) to write a latent image on the charged surface of the latent image bearer, a developing device (e.g., the developing device 4Y) to develop the latent image into a toner image, a transfer device (e.g., the intermediate transfer unit 8) to transfer the toner image onto a transfer medium, a toner adhesion amount detector (e.g., the optical sensor unit 20) to detect an amount of toner adhering to the latent image bearer, and a controller (e.g., the controller 30) configured to form a background fog pattern on a background area of the latent image bearer while changing a background potential, which is a potential difference between the background area of the latent image bearer and a developer bearer (e.g., the developing roller 4*a*Y), adjust a value of the charging bias output from the charge power supply based on a plurality of toner adhesion amount values (i.e., sampled data values) of the background fog pattern, detected by the toner adhesion amount detector at different positions having background, sort the plurality of toner adhesion amount values respectively corresponding to the different positions in the magnitude order (either ascending or descending) of the background potential, exclude any toner adhesion amount value out of monotonicity (monotone decreasing or monotone ascending), refer to only remaining toner adhesion amount values to determine a relation between the background potential and the background fog toner amount, and compute an optimum value of the charging bias based on the determined relation.

According to this aspect, the optimum value of the charging bias can be determined accurately from the following reason. As the background potential acting on the background area of the latent image bearer increases, the background fog toner amount in the background area decreases. Accordingly, when the toner adhesion amount in each section of the background fog pattern is detected and the detected values are sorted in the order of magnitude (either ascending or descending) of the background potential, the detected values exhibit an ascending order or a descending order. Nevertheless, if there is any detected value out of monotonicity, it is highly possible that the detected value has a large error derived from a local stain or a local flaw of the latent image bearer or the transfer medium. Therefore, according to Aspect A, any detected value out of the monotone decreasing or the monotone increasing is excluded. Then, the controller 30 determines the optimum value of the charging bias based on the relation between the background potential and the background fog toner amount determined using only the remaining detected values. In this configuration, the optimum value of the charging bias Vc is determined more accurately because the detected values (sampled data values) including large errors due to local stain or flaw of the latent image bearer or the transfer medium are excluded in computing the relation between the background potential and the background fog toner amount.

Aspect B

In addition to Aspect A, the controller is configured to form, separately from the background fog pattern, a toner image for locating on the latent image bearer by developing a latent image, determine a timing at which the toner image for locating arrives at the detection position by the toner adhesion amount detector based on changes in the output from the toner adhesion amount detector, determine a timing at which each of the different positions in the background fog pattern arrives at the detection position based on the determined timing.

In this aspect, the background fog pattern having multiple sections different in the background fog toner amount are formed by changing the background potential while rotating the latent image bearer. Further, separately from the background fog pattern, the toner image for locating is formed on the latent image bearer by actively promoting adhesion of toner to the electrostatic latent image with the developing potential. When the toner image for locating arrives at the detection position of the toner adhesion amount detector, the output of the toner adhesion amount detector changes significantly. Therefore, the timing at which the toner image for locating arrives at the detection position can be measured precisely based on the changes in the output of the toner adhesion amount detector. When the toner image for locating is disposed near the background fog pattern, the time difference between the arrival timing of the toner image for locating and that of each section of the background fog pattern is significantly smaller than the time difference between the timing at which stepwise change of the charging bias Vc is started to form the background fog pattern and the timing at which each section of the background fog pattern arrives at the detection position. Since the time difference is smaller, the arrival timing of each section of the background fog pattern at the detection position can be detected accurately, differently from clocking processing based on the start timing of stepwise change of the charging bias Vc. This configuration suppresses the occurrence of background fog and carrier adhesion resulting from low accuracy in determining the arrival timing of each section of the background fog pattern at the detection position.

Aspect C

In addition to Aspect B, the controller is configured to change the charging bias while keeping the developing bias applied to the developer bearer in forming the background fog pattern, thereby changing the background potential. According to this aspect, the background fog pattern is formed by changing the charging bias.

Aspect D

In addition to Aspect B or C, the controller is configured to change the background potential from a greater value to a smaller value in forming the background fog pattern. According to this aspect, the background fog toner amount in the background fog pattern gradually increases, thus obviating the need for sorting the detected values (representing the background fog toner amount) in the order of magnitude of background potential.

Aspect E

In Aspect D, the controller is configured to form the toner image for locating on a back of the background fog pattern in the direction in which the latent image bearer rotates. This aspect is advantageous in avoiding decreases in detection accuracy of the background fog property caused by decreases in toner concentration inherent to developing of the toner image for locating.

Aspect F

In any of Aspects B through E, the toner adhesion amount detector includes a plurality of sensors disposed at different positions in a direction (e.g., the belt width direction) perpendicular to a travel direction of the background fog pattern (e.g., the belt travel direction YA), and the controller is configured to adjust the output value of the charging bias based on the detection result generated by each of the plurality of sensors. According to this aspect, the background fog patterns are formed concurrently on a plurality of latent image bearers, thereby reducing the time required to form the background fog patterns.

Aspect G

In any of Aspects B through F, out of the entire range of the background fog pattern, the toner adhesion amount detector is configured to detect the toner adhesion amount in an end range in the direction perpendicular to the direction in which the background fog pattern moves. Accordingly, the detection accuracy of the background fog (background stain) can be improved.

Aspect H

In any one of Aspects A through G, in determining the relation, the controller is configured to further exclude any value deviating from a predetermined range from the toner adhesion amount values detected at the different positions. This aspect is effective to avoid decreases in accuracy in determining the relation between the background fog toner amount and the background potential since any toner adhesion amount value deviating from the lower limit and the upper limit is not referred to.

Aspect I

In any one of Aspects A through H, the image forming apparatus further includes an environment detector to detect an ambient environment, and the controller is configured to measure an accumulative running distance of the latent image bearer and determine a timing to adjust the output value of the charging bias based on the accumulative running distance of the latent image bearer and a detection result generated by the environment detector.

Aspect J

An image forming method includes outputting, from a charge power supply, a charging bias applied to a latent image bearer; charging a surface of the latent image bearer with the charging bias; writing a latent image on the charged surface of the latent image bearer, developing the latent image into a toner image, transferring the toner image onto a transfer medium, forming a background fog pattern on a background area of the latent image bearer while changing a background potential, which is a potential difference between the background area of the latent image bearer and a developer bearer; adjusting a value of the charging bias output from the charge power supply based on a plurality of toner adhesion amount values detected by the toner adhesion amount detector, respectively, at different positions in the background fog pattern and having different potentials, sorting the plurality of toner adhesion amount values respectively corresponding to the different positions in the magnitude order (either ascending or descending) of the background potential, excluding any toner adhesion amount value out of monotonicity (either monotone increasing or monotone decreasing); referring to only remaining toner adhesion amount values to determine a relation between the background potential and the background fog toner amount.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

a latent image bearer to rotate;

an image forming unit including:

a charger to charge a surface of the latent image bearer; and a developing device including a developer bearer disposed facing the latent image bearer, the developing device to develop the latent image into a toner image;

a charge power supply to output a charging bias applied to the charger;

a transfer device to transfer the toner image from the latent image bearer onto a transfer medium;

a toner adhesion amount detector to detect an amount of toner adhering to one of the latent image bearer and the transfer medium; and a controller configured to:

cause the image forming unit to form a background fog pattern in a background area of the latent image bearer while changing a background potential, which is a potential difference between the background area of the latent image bearer and the developer bearer;

acquire a plurality of toner adhesion amount values respectively detected at different positions in the background fog pattern by the toner adhesion amount detector, the different positions having different potentials;

sort the plurality of toner adhesion amount values in a magnitude order of the background potential;

exclude any toner adhesion amount value out of monotonicity from the plurality of toner adhesion amount values;

determine a relation between the background potential and a background fog amount based on a rest of the plurality of toner adhesion amount values; and adjust the charging bias output from the charge power supply to an optimum value computed based on the determined relation between the background potential and the background fog amount.

2. The image forming apparatus according to claim 1, further comprising a latent-image writing device to write a latent image on the charged surface of the latent image bearer, wherein the controller is configured to:

cause the image forming unit to form a toner image for locating on the latent image bearer by latent image developing, differently from the background fog pattern;

determine a first timing at which the toner image for locating arrives at a detection position by the toner adhesion amount detector based on an output change of the toner adhesion amount detector; and determine a second timing at which each of the different positions in the background fog pattern arrives at the detection position based on the first timing.

3. The image forming apparatus according to claim 2, wherein the controller is configured to form the toner image for locating on a back of the background fog pattern in a direction in which the latent image bearer rotates.

4. The image forming apparatus according to claim 1, wherein, in forming the background fog pattern, the controller is configured to change the charging bias while keeping a developing bias applied to the developer bearer constant to change the background potential.

5. The image forming apparatus according to claim 1, wherein, in forming the background fog pattern, the controller is configured to change the background potential from a greater value to a smaller value.

6. The image forming apparatus according to claim 1, wherein the toner adhesion amount detector includes a plurality of sensors disposed at different positions in a direction perpendicular to a travel direction of the background fog pattern, and wherein the controller is configured to adjust the charging bias based on a detection result generated by each of the plurality of sensors.

7. The image forming apparatus according to claim 6, wherein the transfer medium to which the transfer device transfers the toner image from the latent image bearer is an intermediate transfer member, and wherein the plurality of sensors is disposed facing the intermediate transfer member to detect the background fog pattern on the intermediate transfer member.

8. The image forming apparatus according to claim 1, wherein, out of an entire range of the background fog pattern, the toner adhesion amount detector is disposed facing an end range in a direction perpendicular to a travel direction of the background fog pattern to detect the toner adhesion amount in the end range.

9. The image forming apparatus according to claim 1, wherein, in determining the relation between the background potential and the background fog amount, the controller is configured to further exclude any value deviating from a predetermined range from the plurality of toner adhesion amount values detected at the different positions.

10. The image forming apparatus according to claim 1, further comprising an environment detector to detect an ambient environment, wherein the controller is configured to measure an accumulative running distance of the latent image bearer and determine a timing to adjust the charging bias based on the accumulative running distance of the latent image bearer and a detection result generated by the environment detector.

11. A charging bias adjusting method comprising:

forming a background fog pattern in a background area of a latent image bearer while changing a background potential, which is a potential difference between the background area of the latent image bearer and a developer bearer;

acquiring a plurality of toner adhesion amount values respectively detected at different positions in the background fog pattern, the different positions having different potentials;

sorting the plurality of toner adhesion amount values in a magnitude order of the background potential;

excluding any toner adhesion amount value out of monotonicity from the plurality of toner adhesion amount values;

determining a relation between the background potential and a background fog amount based on a rest of the plurality of toner adhesion amount values; and adjusting the charging bias to an optimum value computed based on the determined relation between the background potential and the background fog amount.

* * * * *